US011590768B2

(12) United States Patent
Levi et al.

(10) Patent No.: US 11,590,768 B2
(45) Date of Patent: Feb. 28, 2023

(54) INTEGRATED VERTICAL PORTABLE INKJET PRINTER

(71) Applicant: WALLART LTD., Kfar Yona (IL)

(72) Inventors: Yaakov Levi, Kfar Yona (IL); Eldad Lapidot, Rosh Haain (IL)

(73) Assignee: WALLART LTD., Kfar Yona (IL)

( * ) Notice: Subject to any disclaimer, the term of this patent is extended or adjusted under 35 U.S.C. 154(b) by 100 days.

(21) Appl. No.: 16/490,083

(22) PCT Filed: Mar. 4, 2018

(86) PCT No.: PCT/IB2018/051371
§ 371 (c)(1),
(2) Date: Aug. 30, 2019

(87) PCT Pub. No.: WO2018/163036
PCT Pub. Date: Sep. 13, 2018

(65) Prior Publication Data

US 2020/0062003 A1 Feb. 27, 2020

Related U.S. Application Data

(60) Provisional application No. 62/467,142, filed on Mar. 5, 2017.

(51) Int. Cl.

| | |
|---|---|
| ***B41J 3/407*** | (2006.01) |
| ***B41J 3/54*** | (2006.01) |
| ***B41J 11/00*** | (2006.01) |

(52) U.S. Cl.
CPC ..... *B41J 3/4073* (2013.01); *B41J 3/543* (2013.01); *B41J 11/00214* (2021.01); *B41J 11/00218* (2021.01)

(58) Field of Classification Search
CPC ..... B41J 3/4073; B41J 3/543
See application file for complete search history.

(56) References Cited

U.S. PATENT DOCUMENTS

| | | | |
|---|---|---|---|
| 3,847,112 | A | 11/1974 | Wise |
| 2004/0247358 | A1 | 12/2004 | Cannell |

(Continued)

FOREIGN PATENT DOCUMENTS

| | | | |
|---|---|---|---|
| CN | 203046466 | U | 7/2013 |
| CN | 104827779 | A | 8/2015 |

(Continued)

OTHER PUBLICATIONS

Machine translation of CN 203046466 U. (Year: 2013).*

(Continued)

*Primary Examiner* — Justin Seo
(74) *Attorney, Agent, or Firm* — Manelli Selter PLLC; Edward Stemberger

(57) ABSTRACT

An integrated vertical inkjet printer for printing on a vertical substrate, comprising: a controller; a main trolley carrying a main trolley body; and a printing assembly, comprising: a plurality of inkjet printing head assemblies mounted on a platform; a vertical telescopic tandem beam system comprising: a first printing beam, wherein said platform is slidable along said first printing beam; and a second printing beam detachably insertable between said first printing beam and said main trolley body, a first motor configured to drive said platform vertically; and a second motor configured to drive said first printing beam along said second printing beam.

21 Claims, 29 Drawing Sheets

(56) References Cited

U.S. PATENT DOCUMENTS

| | | | | |
|---|---|---|---|---|
| 2006/0044333 | A1* | 3/2006 | Nishikori | B41J 11/0065 347/9 |
| 2006/0202646 | A1* | 9/2006 | Kojima | B41J 13/0027 318/34 |
| 2010/0016106 | A1* | 1/2010 | Minemura | B41J 3/4071 474/113 |
| 2011/0132729 | A1* | 6/2011 | Chisholm | B41J 3/4073 198/867.11 |
| 2016/0297207 | A1* | 10/2016 | Chang | B41J 2/04586 |

FOREIGN PATENT DOCUMENTS

| | | | |
|---|---|---|---|
| CN | 104842651 | A | 8/2015 |
| CN | 205421857 | U | 8/2016 |
| CN | 105587107 | A | 2/2018 |
| WO | 2015095990 | A1 | 7/2015 |

OTHER PUBLICATIONS

Machine translation of CN 104842651 U. (Year: 2015).*
International Search Report in PCT/IB2018/051371 dated Jun. 24, 2018.

* cited by examiner

INTEGRATED VERTICAL PORTABLE INKJET PRINTER

CROSS-REFERENCE TO RELATED PATENT APPLICATIONS

This patent application claims priority from and is related to U.S. Provisional Patent Application Ser. No. 62/467,142, filed Mar. 5, 2017, this U.S. Provisional patent application incorporated by reference in its entirety herein.

TECHNOLOGY FIELD

The present invention generally relates to printers and specifically to vertical inkjet printing.

BACKGROUND

Printing on horizontal surfaces is well known in the art.

Printing on vertical surfaces though is a developing industry.

While printing on vertical surfaces, there is a need to create flawless image covering, as much as possible, on the printed surface.

SUMMARY

According to an aspect of the present invention there is provided an integrated vertical inkjet printer for printing on a vertical substrate, comprising: a controller; a main trolley carrying a main trolley body; and a printing assembly, comprising: a plurality of inkjet printing head assemblies mounted on a platform; a vertical telescopic tandem beam system comprising: a first printing beam, wherein the platform is slidable along the first printing beam; and a second printing beam detachably insertable between the first printing beam and the main trolley body, a first motor configured to drive the platform vertically; and a second motor configured to drive the first printing beam along the second printing beam.

The integrated vertical inkjet printer may further comprise at least one distance sensor configured to provide accurate positioning of the integrated vertical inkjet printer in relation to the substrate.

The main trolley may be mounted on four wheels and may comprise automatic floor-leveling elements.

The integrated vertical inkjet may further comprise two vertical linear encoders configured to provide accurate location of the first and second printing beams, respectively, to the controller.

The plurality of inkjet printing head assemblies may comprise printing heads mounted above and below the platform, wherein the controller may be configured to perform special printing sequences when the heads reach the ceiling or the floor of the substrate, respectively.

According to another aspect of the present invention there is provided an integrated vertical inkjet printer for printing on a vertical substrate, comprising: a controller; a main trolley carrying a main trolley body; a first extension trolley carrying a first extension trolley body; two first horizontal rails detachably connecting the main trolley body and the first extension trolley body; and a printing assembly movable along the two horizontal rails, comprising a plurality of inkjet printing head assemblies mounted on a platform, wherein the plurality of inkjet printing head assemblies comprise printing heads mounted to the right and to the left of the platform; and wherein the controller is configured to perform special printing sequences when the heads reach the right wall or the left wall of the substrate, respectively.

The integrated vertical inkjet may further comprise: a second extension trolley carrying a second extension trolley body; two second horizontal rails detachably connecting the first extension trolley body and the second extension trolley body; a printing assembly movable along the two first horizontal rails and the two second horizontal rails, the printing assembly comprising a plurality of inkjet printing head assemblies mounted on a platform, the platform slidable along a vertical beam; a timing belt mechanism configured to provide smooth transition of the printing assembly on each of the two first and second horizontal rails and in between the two first horizontal rails and the two second horizontal rails; a first linear encoder scale connected with the two first horizontal rails; a second linear encoder scale connected with the two second horizontal rails; and a linear encoder reader comprising two reading heads, wherein only one of the reading heads is operable at any given time.

The integrated vertical inkjet printer may further comprise at least one distance sensor configured to provide accurate positioning of the integrated vertical inkjet printer in relation to the substrate.

The main trolley and the first and second extension trolleys are each may be mounted on four wheels and may comprise automatic floor-leveling elements.

The timing belt may comprise two tangential timing belts.

The integrated vertical inkjet printer may further comprise means for mapping the substrate's planar profile before or during printing.

The means for mapping may comprise a distance sensor.

The controller may further be configured to calculate a smooth distance movement profile for the printing assembly, based on the mapping.

The printing heads assembly may comprise a printing head configured to print a background color.

The background color may comprise a primer.

The integrated vertical inkjet printer may further comprise UV monochromatic light Emitting Diodes (UV LED) configured to cure the primer.

The UV LED may be mounted near the printing head assembly.

According to another aspect of the present invention there is provided a method of printing on a vertical substrate, comprising: providing a printing assembly comprising four printing head assemblies, two background printing head assemblies, two image UV monochromatic light Emitting Diodes (UV LEDs) and two background monochromatic light Emitting Diodes (UV LEDs); printing, by the two background printing head assemblies, a background color while moving in a first horizontal direction from a starting point; curing, by the two background UV LEDs, the background color; moving the two background printing head assemblies to the other side of the printing assembly; returning, by the printing assembly, in a second horizontal direction to the starting point; printing, by the printing head assemblies, while moving in the first horizontal direction an image; and curing, by the two image UV LEDs, the printed image.

The method may further comprise: moving the two background printing head assemblies to the other side of the printing assembly; continue printing the image while curing the background color; folding the background UV LEDs and continue printing the image; and moving in the second horizontal direction while curing the printed image.

According to another aspect of the present invention there is provided a timing belt mechanism, comprising: at least two pulleys; wherein at least one of the at least two pulleys is activated by a motor; and a timing belt stretched around the at least two pulleys; wherein at least part of the timing belt is configured to be in contact with a second belt thereby accurately moving the second belt.

The second belt may be a conveyor timing belt.

The timing belt mechanism may further comprise at least one encoder comprising at least one reading head and at least one encoder scale.

BRIEF DESCRIPTION OF THE DRAWINGS

For better understanding of the invention and to show how the same may be carried into effect, reference will now be made, purely by way of example, to the accompanying drawings.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF EMBODIMENTS

For better understanding of the invention and to show how the same may be carried into effect, reference will now be made, purely by way of example, to the accompanying drawings.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings:

The present invention provides an integrated vertical inkjet printer to be used for printing on walls, glass or any other substrate at the customer's location.

The integrated printer of the present invention is distinguished from prior art printers, inter alia, by its mobility in a ready-to-print state, where no assembly is required on site.

Additionally, the printer is designed such that it may easily access common spaces (e.g. stairs, doorways, elevators, pavements), is adaptable to varying width (e.g., wall width) and heights (e.g., ceiling height), overcomes substrate irregularities without loss of image quality and is adaptable to various substrates by printing an appropriate primer layer simultaneously with printing the main image.

The integrated printer of the present invention is designed for minimum installation time, using its capabilities of mobility, automatic leveling and automatic initial positioning, as will be described in details below.

Figure 1:
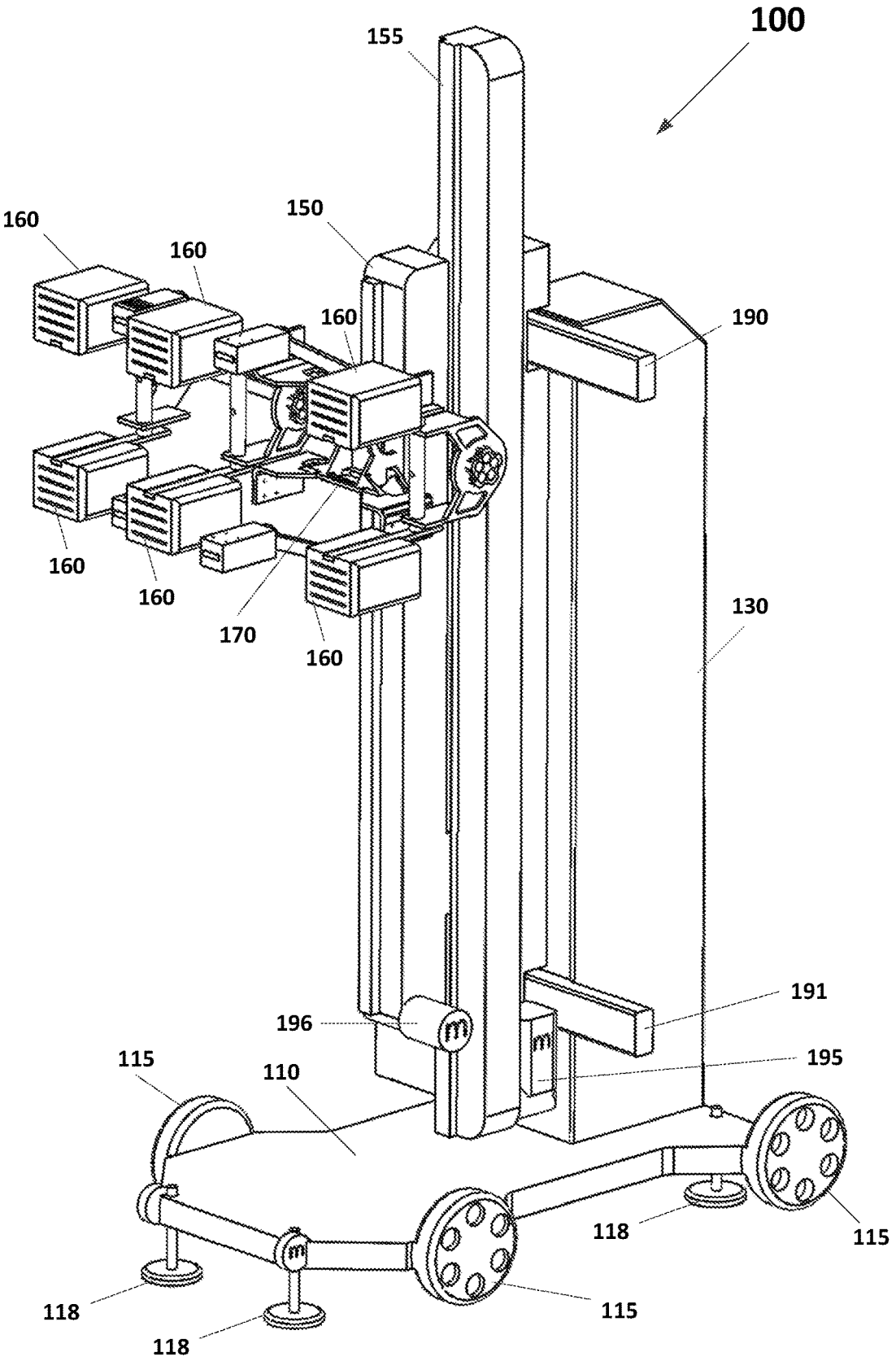
FIG. 1 is a schematic perspective view of the integrated vertical inkjet printer in a basic configuration, according to embodiments of the present invention.

FIG. 1 is a schematic perspective view of the integrated vertical inkjet printer 100 in a basic configuration, according to embodiments of the present invention, comprising:

A main trolley 110 supported on four "omni wheels" 115 (with electric drive—only three are shown) having an electric folding mechanism (not shown). After the printer has been wheeled to position the wheels are folding up and the trolley stands on four automatic floor-leveling elements 118 (only three are shown) using leveler sensors to provide automatic flatness.

A main trolley body 130 connected to the main trolley 110 and extending vertically therefrom;

Two connecting rails 190, 191 connected to the main trolley body 130;

A printing assembly, including:

An electronics cabinet (not shown) including a system controller and a computer running a dedicated print application;

A vertical telescopic tandem beam system comprising:

a first printing beam 150;

a second printing beam 155 detachably insertable between the first printing beam 150 and the main trolley body 130.

A motor 195 drives the first printing beam 150 vertically up and down the second printing beam 155 during the printing process, thus enabling vertical printing reach beyond the height of the first printing beam 150.

A plurality inkjet printing head assemblies 160 mounted on a platform 170, which is slidable along the first printing beam 150 using motor 196.

At least one distance sensor (not shown), provides accurate positioning of the integrated vertical inkjet printer 100, according to received instructions regarding the print location on the substrate, i.e., distance from substrate right edge, distance from substrate left edge, and distance from the ceiling.

It will be appreciated that the integrated vertical inkjet printer 100 of the present invention is not limited to the number of printing head assemblies shown. Any number of printing head assemblies may be used (less or more).

It will be appreciated that the wheels 115 are not limited to be folded.

Figure 2:
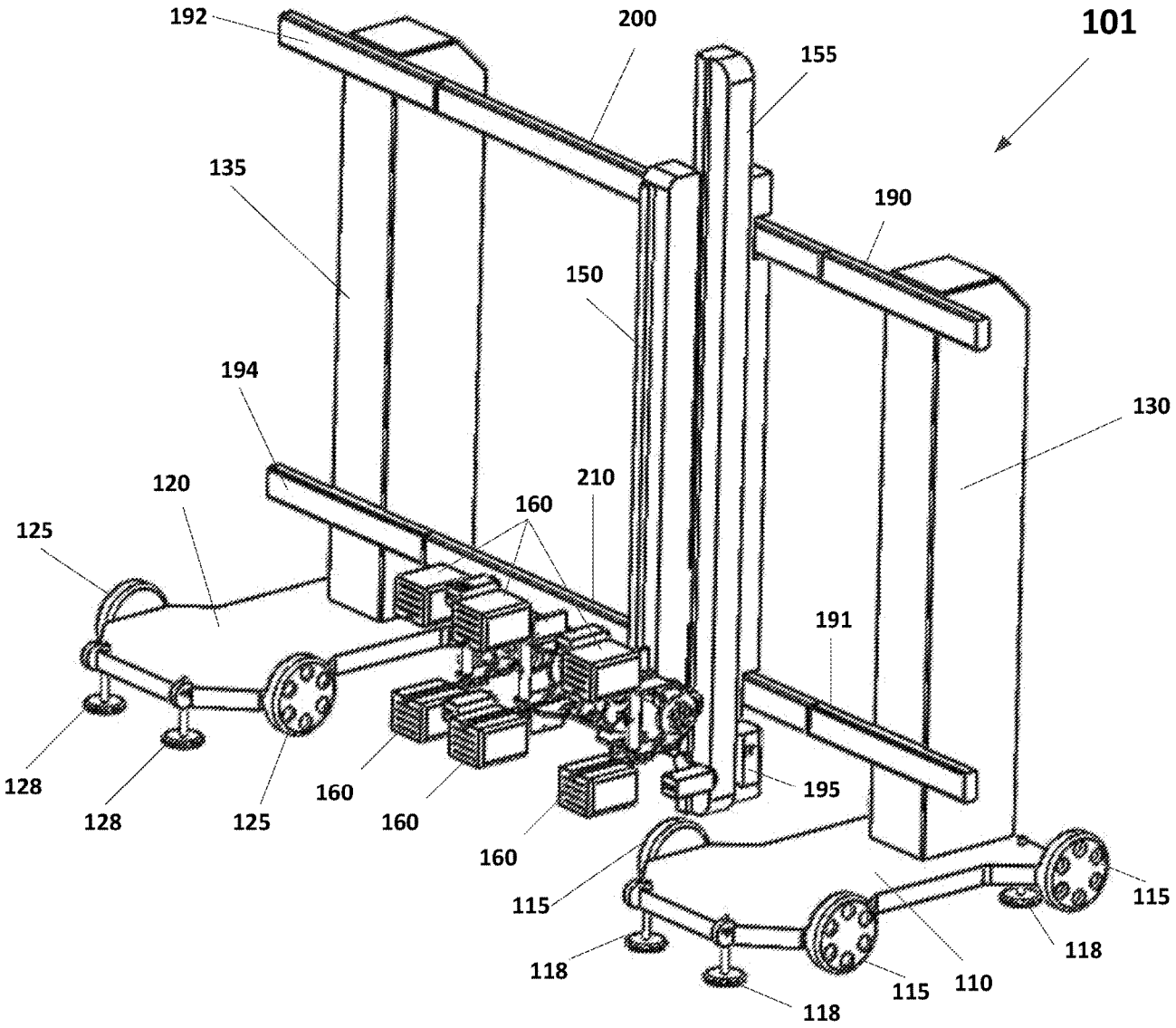
FIG. 2 is a schematic perspective view of the integrated vertical inkjet printer in an extended configuration, according to embodiments of the present invention.

FIG. 2 is a schematic perspective view of the integrated vertical inkjet printer 101 in an extended configuration, according to embodiments of the present invention.

Printer 101 comprises, on top of the basic configuration described in conjunction with FIG. 1:

An extension trolley 120 supported on four omni wheels 125 (without electric drive—two not shown) and four floor-leveling extensions 128 (two not shown);

An extension trolley body 135 connected to the extension trolley 120 and extending vertically therefrom;

An upper horizontal rail 200 and a lower horizontal rail 210 extending between trolley bodies 130 and 135; the two horizontal rails are detachably connected in a fast connector method to the two main trolley connecting rails 190, 191 respectively on their near side and to two similar extension trolley connecting rails 192, 194 on their distal side;

The printing assembly is movable along the two horizontal rails 200, 210 and the trolleys connecting rails 190,191.

According to embodiments of the present invention, the horizontal rails 200 and 210 may be of a fixed length or an adjustable length.

Figure 3:
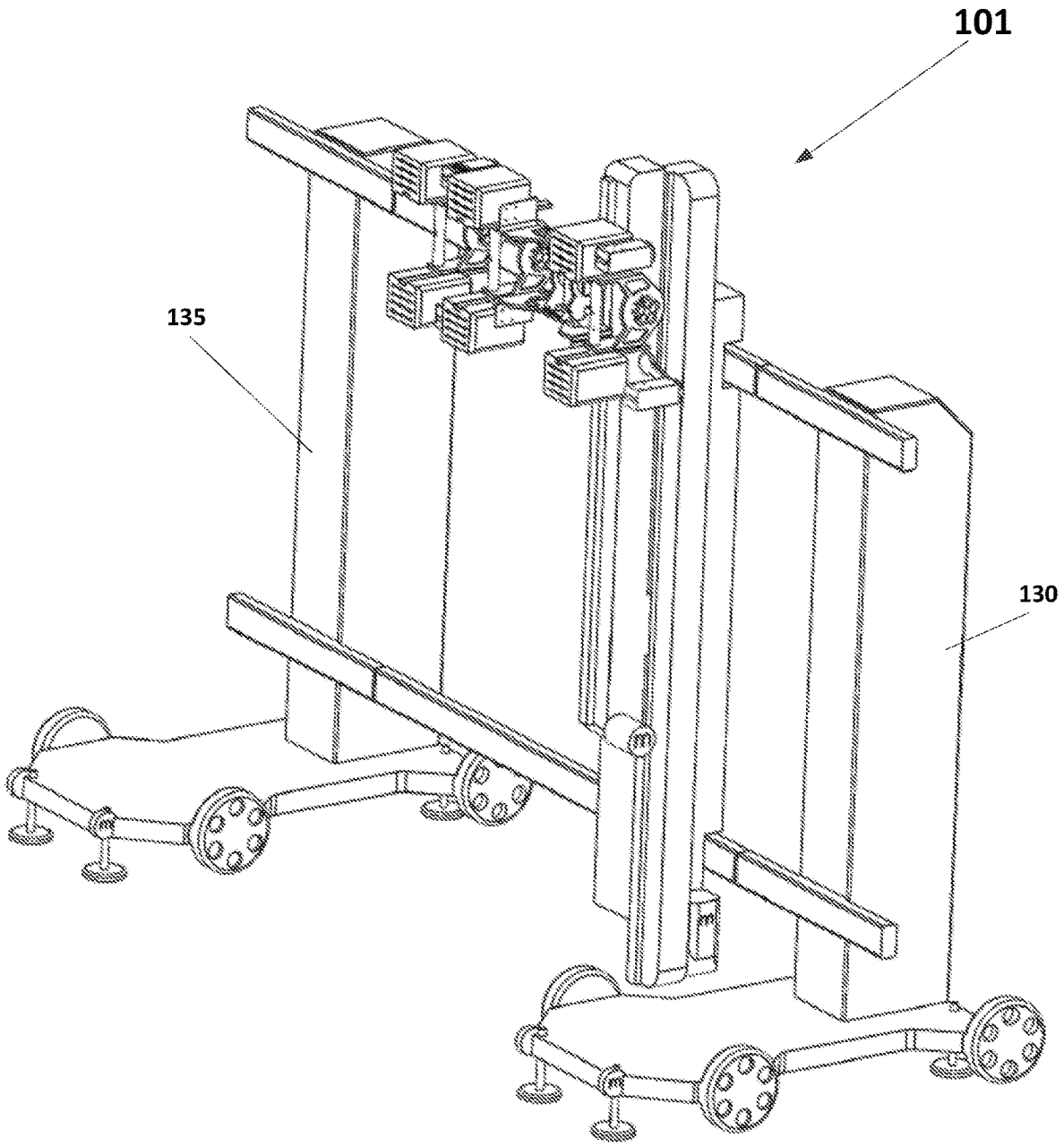
FIG. 3 is a schematic perspective view of the integrated vertical inkjet printer in operation, according to embodiments of the present invention.

FIG. 3 is a schematic perspective view of the integrated vertical inkjet printer 101 in operation, according to embodiments of the present invention. The printing assembly is shown horizontally between trolley bodies 130 and 135.

Figure 4C:
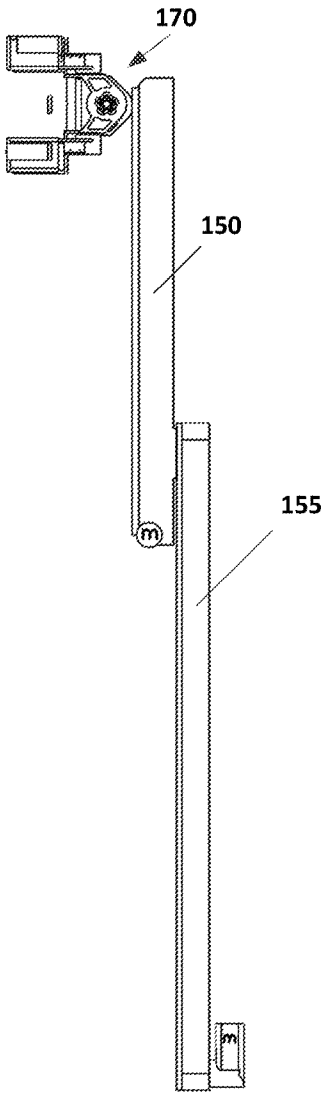
FIGS. 4A through 4C are schematic representations of the vertical telescopic tandem beam system, showing three different relative positions of the vertical beams and printing heads platform, according to embodiments of the present invention.
Figure 4B:
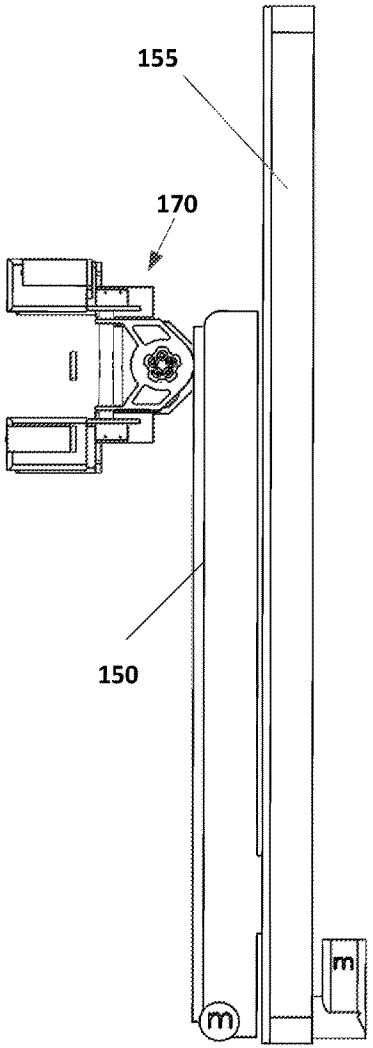
Figure 4A:
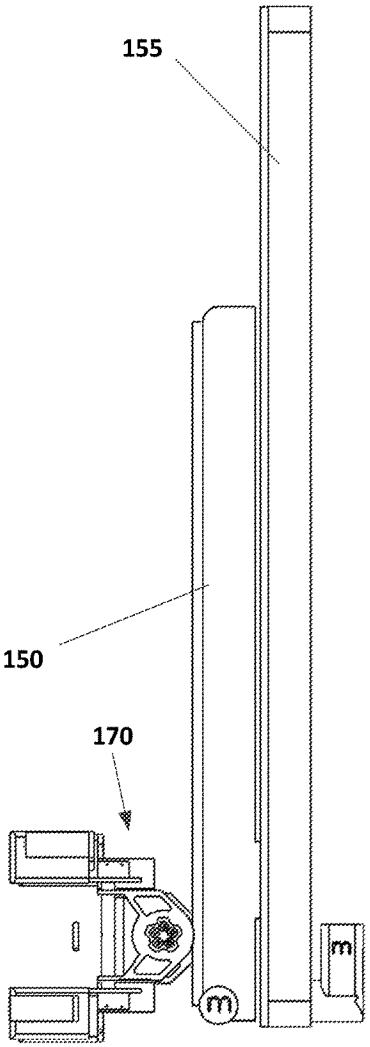

FIGS. 4A through 4C are schematic representations of the vertical telescopic tandem beam system, showing three different relative positions of the vertical beams 150 and 155. In FIG. 4A beams 150 and 155 are at the same vertical position, with printing heads platform 170 at the bottom of beam 150. In FIG. 4B beams 150 and 155 are at the same vertical position, with printing heads platform 170 at the top of beam 150. In FIG. 4C beam 150 has slid vertically against beam 155 and the printing heads platform 170 is at the top of beam 150.

Figure 4D:
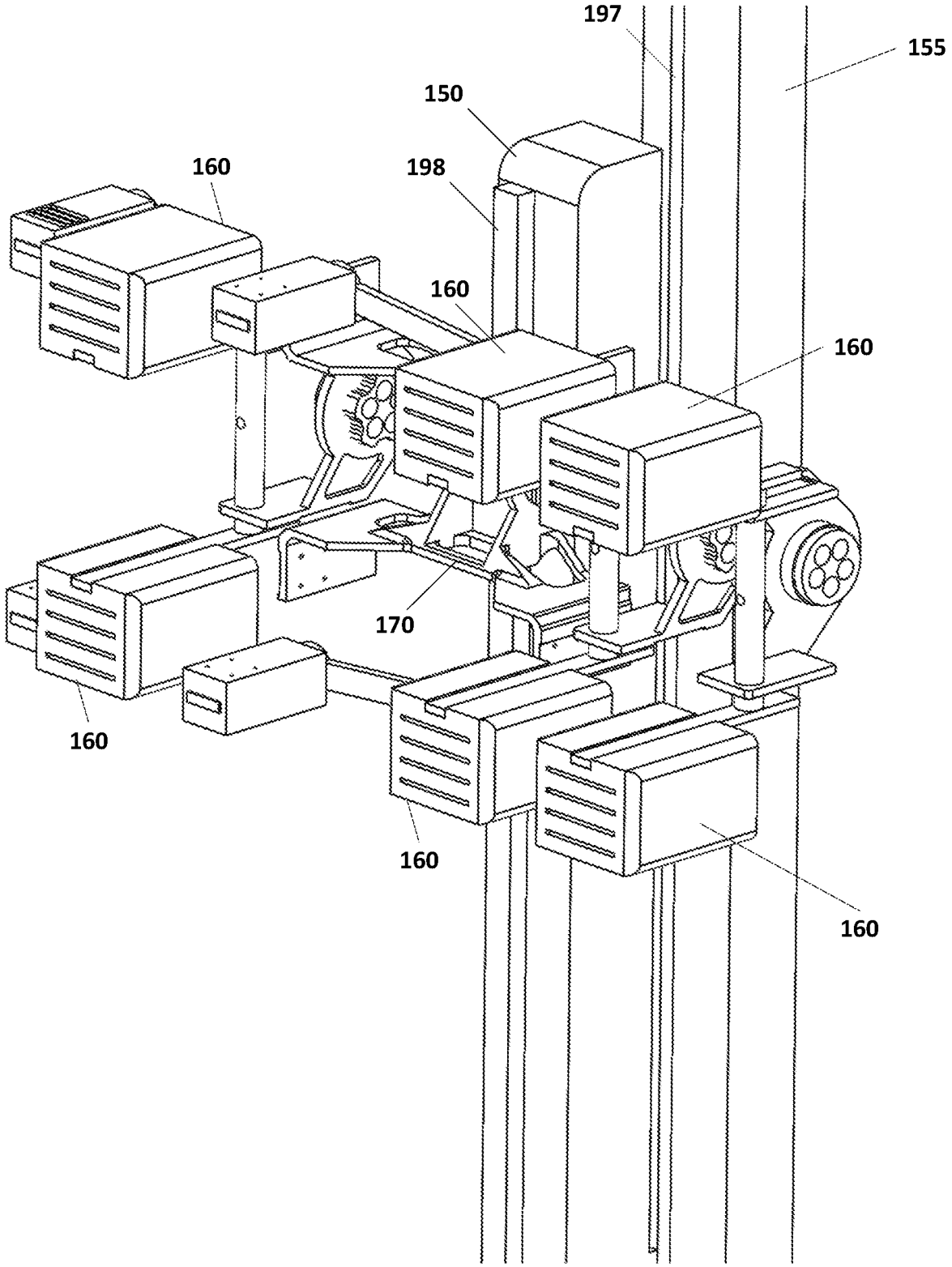
FIG. 4D is a schematic close-up representation of the beams, printing heads platform and inkjet printing head assemblies, according to embodiments of the present invention.

FIG. 4D is a schematic close-up representation of beams 150 and 155, printing heads platform 170 and inkjet printing head assemblies 160, showing slider 197, that allow the sliding of beam 150 along beam 155 and slider 198 that allows the sliding of printing heads platform 170 along beam 150.

According to embodiments of the present invention, two vertical linear encoders (not shown), each for one of the vertical printing beams 150 and 155, provide accurate vertical location data to the system controller. The exact location is calculated by interpolating the readings of the two vertical linear encoders.

Figure 5A:
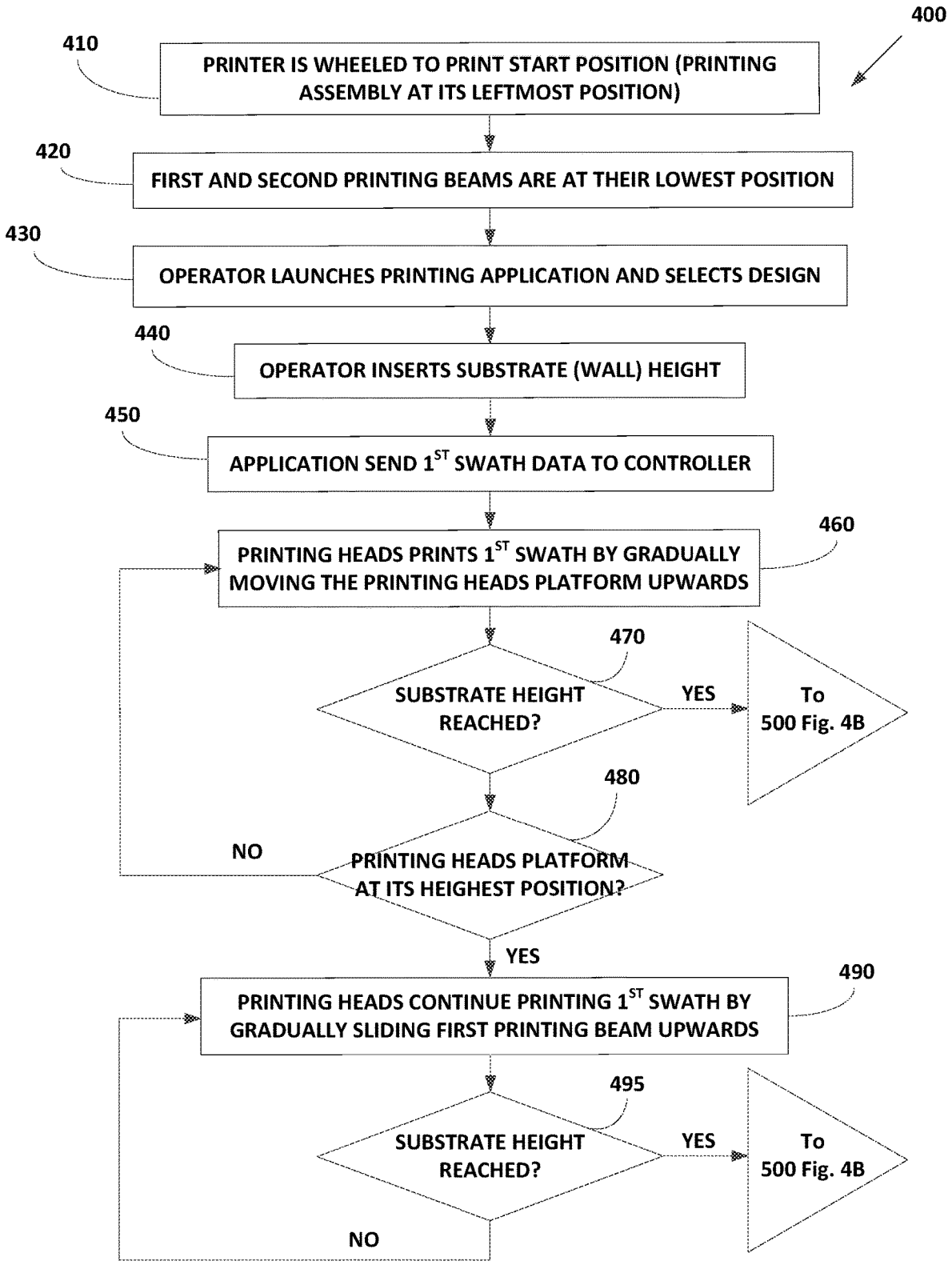
FIGS. 5A and 5B are a flowchart showing an exemplary process for operating the integrated vertical inkjet printer for printing a number of vertical swaths, according to embodiments of the present invention.
Figure 5B:
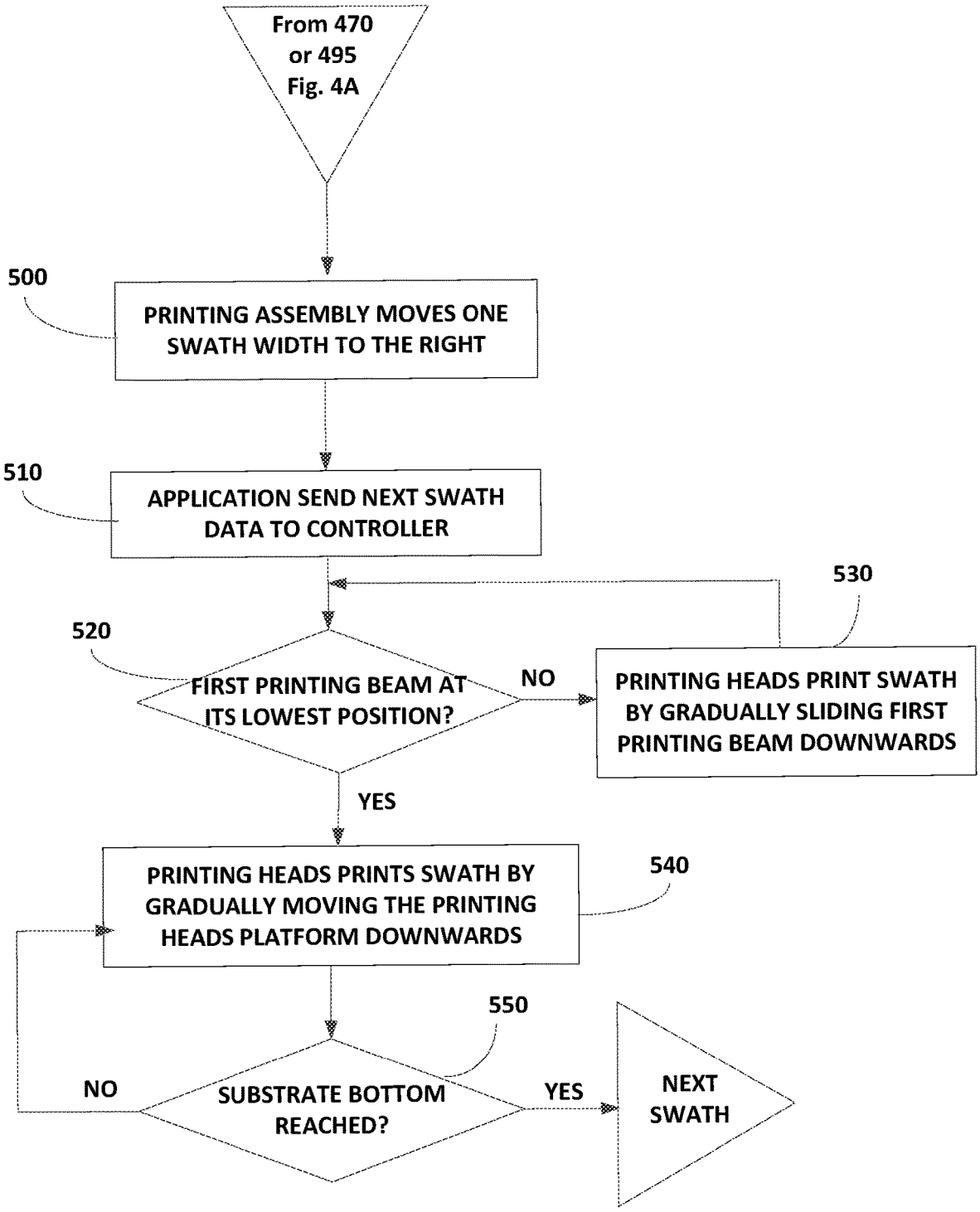

FIGS. 5A and 5B are a flowchart 400 showing the basic steps taken for operating the integrated vertical inkjet printer 101 for printing a number of vertical swaths, according to embodiments of the present invention:

410—Printer is wheeled to print start position, with the printing assembly at its starting (e.g., leftmost) position.

420—First and second printing beams (with print heads platform) are at their initial (e.g., lowest) position.

430—Operator uses print application user interface to select a design.

440—Operator inserts substrate start (e.g., bottom-left) coordinate and print dimensions, or substrate dimensions (e.g., wall height and width) into print application user interface. The mentioned dimensions can alternatively be inserted automatically by the distance sensors located on the main trolley and the printing assembly.

450—Application retrieves at least $1^{st}$ swath data for the selected design from database and sends data to the controller.

460—$1^{st}$ swath is printed by gradually moving the print heads platform upwards, while the first printing beam is fixedly attached to the second printing beam.

470—Prior to each upward move the controller checks whether the full substrate height (or design height) has been printed. If it has—the $1^{st}$ swath printing is ended and the process continues in step 500 of FIG. 5B.

480—If the full substrate height (or design height) has not been printed yet, the controller checks whether the print heads platform is about to reach its maximal highest position. If not—printing of the swath is continued (460).

490—before the print heads platform has reached its highest position but still while moving, and if the full substrate height has not been printed yet, the first printing beam starts sliding upward (while the print heads platform is still moving up) along the first printing beam to continue smooth printing, e.g., the vertical printing is achieved by synchronizing the dual relative movement of the first beam and the print heads platform simultaneously.

495—Prior to each upward move the controller checks whether the full substrate height (or design height) has been printed. If it has—the 1st swath printing is ended and the process continues in step 500 of FIG. 5B. If the full substrate height (or design height) has not been printed yet, the process returns to step 490.

500—In order to print the next swath, the controller moves the printing assembly one swath width to the right.

510—Application retrieves next swath data for the selected design from database (or memory) and sends data to the controller.

520—The controller checks whether the first printing beam is at its lowest position, meaning the substrate height did not required vertical extension of the telescopic tandem beam system.

530—As long as the first printing beam has not reached its lowest position, it slides downward along the second printing beam to print the swath.

540—Before the first printing beam has reached its lowest position but while still moving, the swath is printed by gradually moving the printing heads platform downward.

Namely, the vertical printing is achieved by synchronizing the dual relative movement of the first printing beam and the printing heads platform simultaneously.

550—Step 540 is repeated until the substrate bottom is reached, and the system prepares for printing the next swath in a similar manner to that described in conjunction with FIG. 5A.

It will be appreciated that the starting position of the printing assembly is not limited to be the leftmost position. According to embodiments of the present invention, the printing assembly's starting position may be the rightmost position or any position between the rightmost and leftmost positions.

It will be appreciated that the initial position of the first printing beam (with printing heads platform) is not limited to be the lowest position. According to embodiments of the present invention, the first printing beam (with printing heads platform) may be at the highest position allowed by the printed substrate or at any position between the lowest and highest positions.

In each of the above positioning scenarios, together or separately, the process described in conjunction with FIG. 5A and 5B may be performed similarly with direction adjustments.

It will be appreciated that the process described in conjunction with FIGS. 5A and 5B is not limited to the exact movements described.

According to embodiments of the present invention, the printing process may be done by:

1. Moving the printing head assemblies and then the first printing beam.
2. Moving the first printing beam and then the printing head assemblies.
3. Moving only the printing head assemblies.
4. Moving only the first printing beam.
5. Moving the first printing beam and the printing head assemblies simultaneously.

The moving method may be automatically selected by the system controller according to the printed substrate, image size, image location, constraints, etc.

Figure 6:
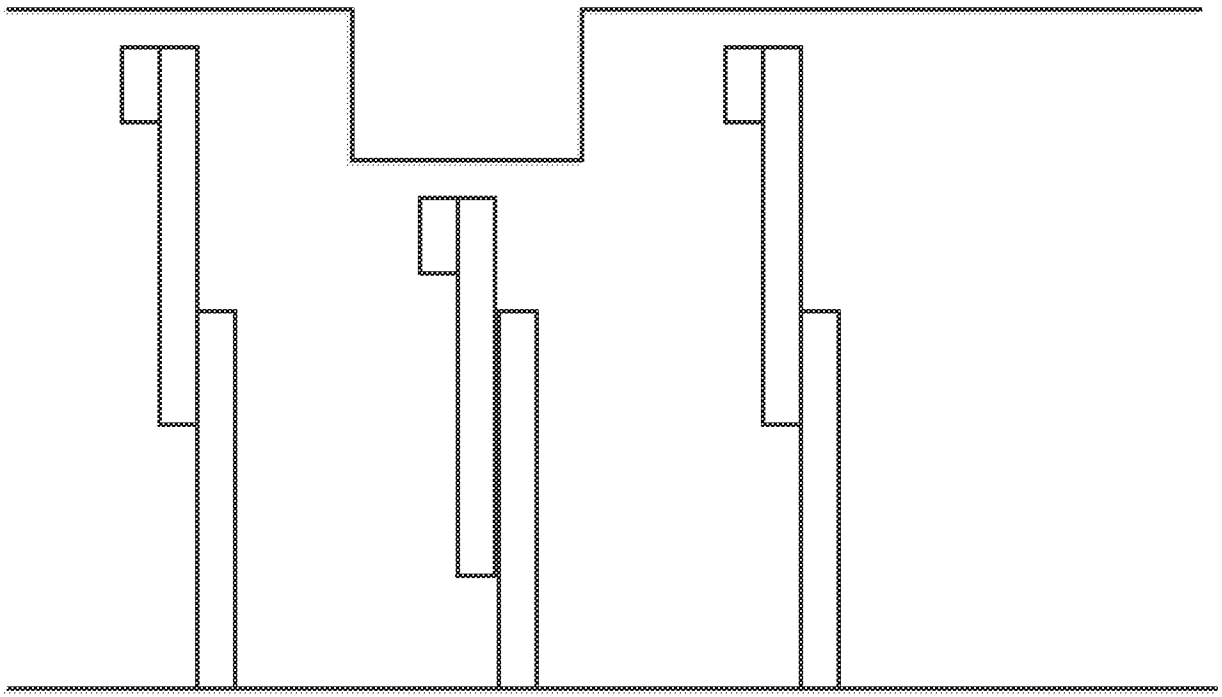
FIG. 6 shows another exemplary use of the vertical telescopic tandem beam system for continuous printing across obstacles blocking parts of the substrate, according to embodiments of the present invention.

FIG. 6 shows another exemplary use of the vertical telescopic tandem beam system for continuous printing across obstacles blocking parts of the substrate, such as beams hanging from the ceiling.

As mentioned above, according to embodiments of the present invention the basic integrated vertical inkjet printer 100, with or without the vertical telescopic tandem beam system (e.g. with a single vertical beam on which the printing heads platform is sliding vertically) may be horizontally extended to enable printing on varying width substrates extending beyond the size of rails 200 and 210 of FIG. 2.

Figure 7:
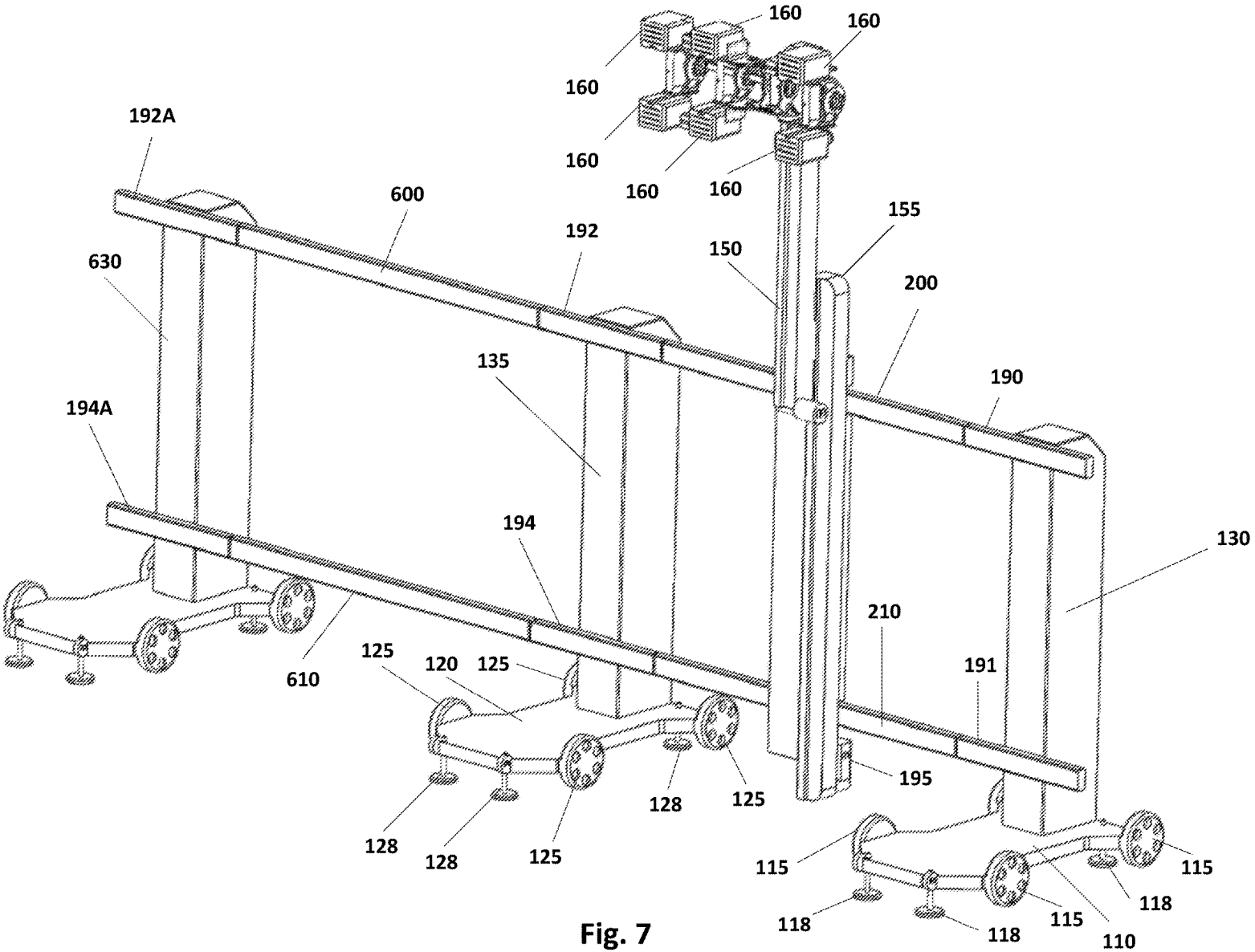
FIG. 7 is a schematic perspective view of the integrated vertical inkjet printer in another extended configuration, according to embodiments of the present invention.

The width extension may be done by two additional upper and lower horizontal rails 600 and 610 as shown in FIG. 7, supported on their near side in a fast connector method to the other side of the extension trolley connecting rails 192, 194 respectively and on their distal side to similar extension trolley connecting rails 192A and 194A on a third extension trolley body 630.

It will be appreciated that additional trailers, trolley bodies and fixed or variable length extension rails may be similarly connected horizontally, to print an image on the entire substrate width.

It will be appreciated that the last extension may be of a varying length to fit to the substrate width or it may be a flexible folding extension.

Figure 8A:
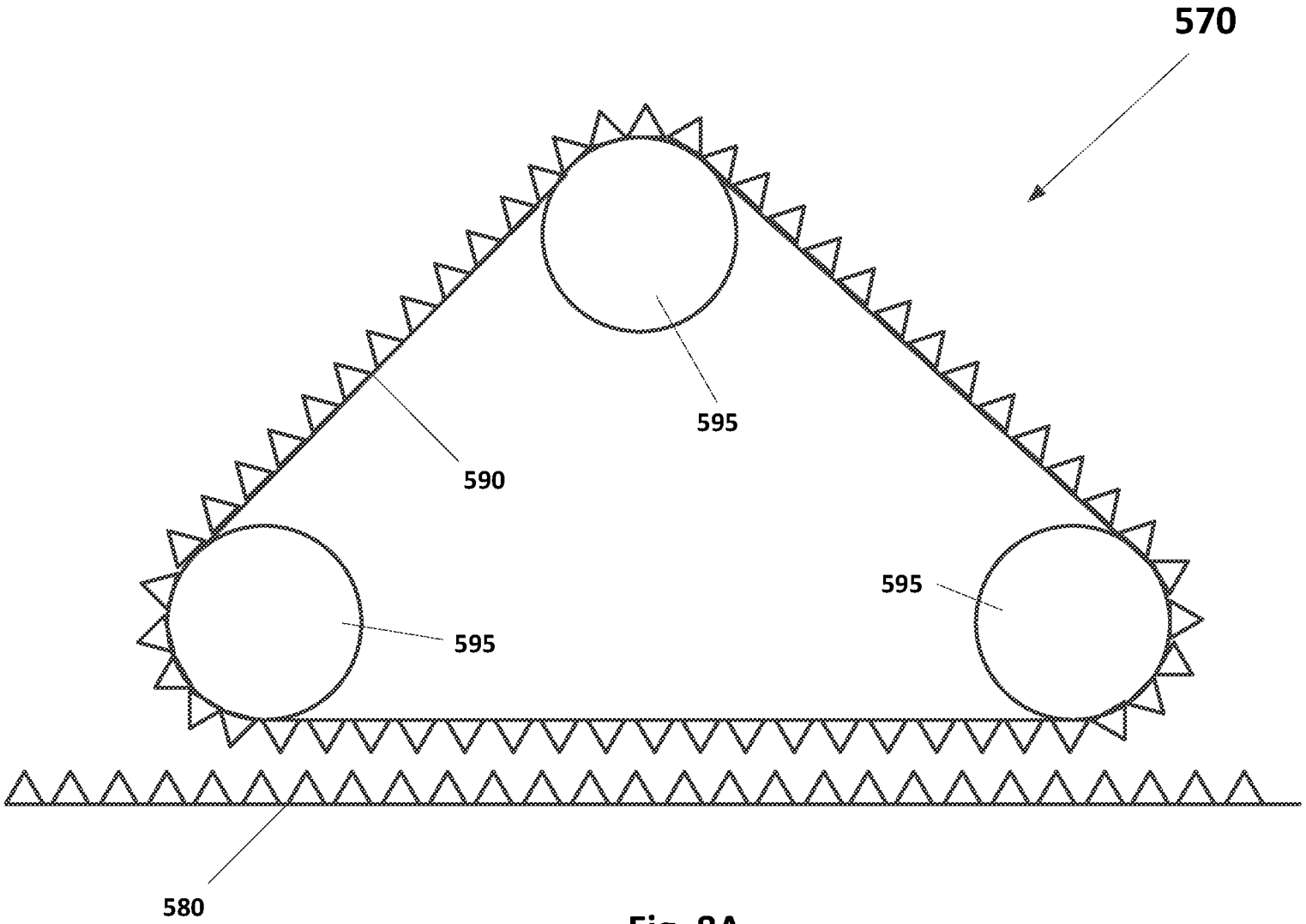
FIG. 8A is a schematic drawing of a timing belt mechanism according to embodiments of the present invention.
Figure 8B:
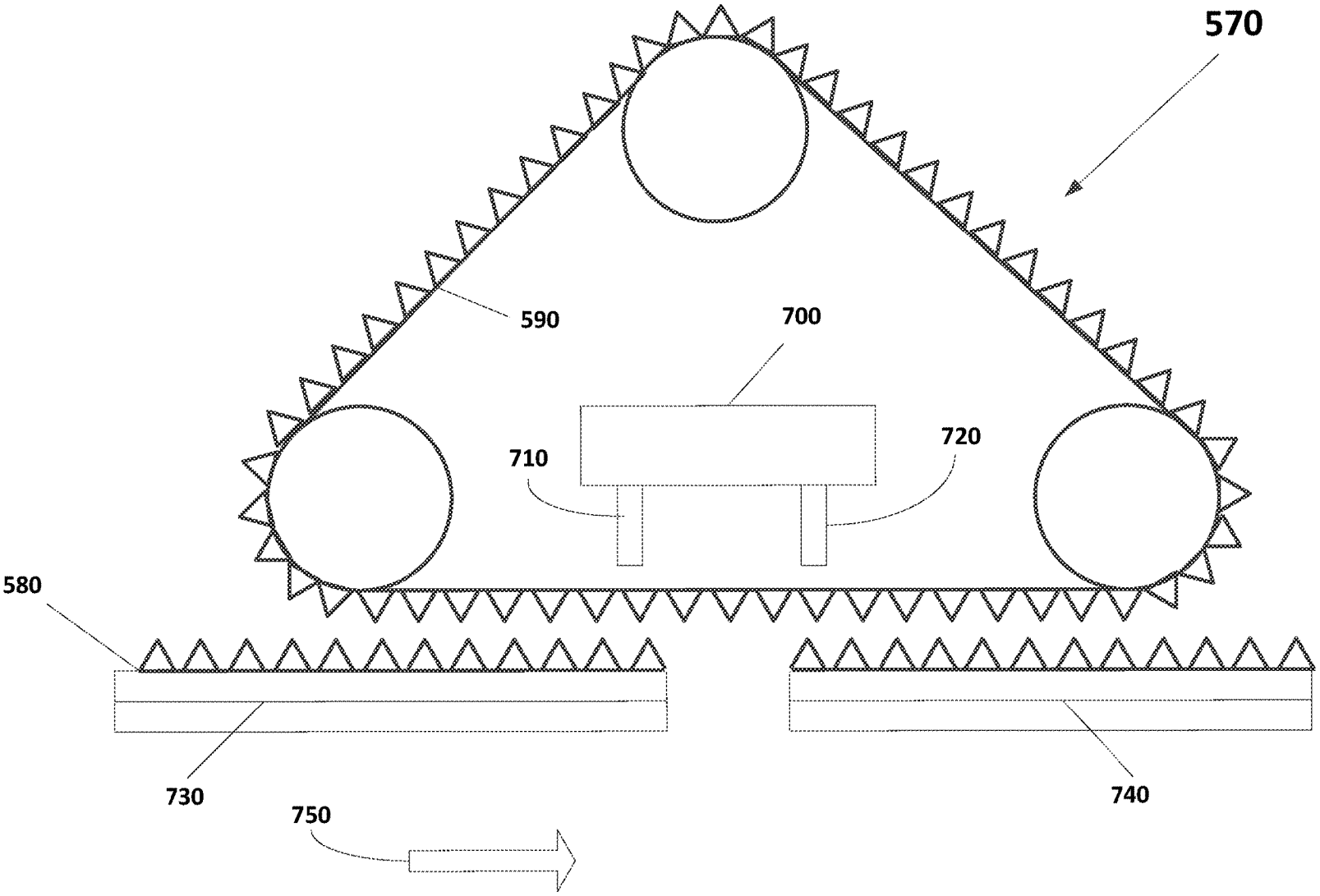
FIG. 8B is a schematic drawing of a timing belt mechanism of FIG. 8A, traversing between two horizontal rails; a horizontal linear encoder and double encoder readers, according to embodiments of the present invention.

According to embodiments of the present invention, a smooth and accurate traversing of the printing assembly between two width extensions may be enabled by:

1. A timing belt mechanism 570 (FIG. 8A) for smooth transition on horizontal rails. The timing belt mechanism 570 comprises a tangential timing belt 590 intended to be in contact with tangential timing belt 580, and at least two pulleys 595 (three are shown), where at least one of the pulleys is activated by a motor (not shown) and the others may be passive. The tangential timing belt 590 provides accurate advancement of the printing assembly along the upper horizontal rail 200, and also from the upper horizontal rail 200 to the adjacent connecting rail 192 and similarly to horizontal rail 600 due to the wide base of the timing belt 590, as shown in FIG. 8B.
2. A horizontal linear encoder and reader, as shown schematically in FIG. 8B. The horizontal linear encoder 700 comprises separate encoder scales 730 and 740, one for each width extension.

According to embodiments of the present invention, an additional timing belt mechanism provides accurate advancement of the printing assembly along the lower horizontal rail 210 and also from the upper horizontal rail 200 to the adjacent connecting rail 194 and similarly to horizontal rail 610.

The linear encoder reader 700 provides smooth and accurate transition between two horizontal width extensions, in the direction of arrow 750. The horizontal linear encoder reader 700 has two reading heads (710, 720) positioned at a predetermined horizontal distance from each other for accurate reading of the printing assembly's location. The controller determines when to switch to the second reading head of the encoder reader when the printing assembly passes to the horizontal extension.

It will be appreciated that the timing belt mechanism 570 is not limited to the present invention. The timing belt mechanism 570 may be applicable in any transmission system, conveyor system, or any other system intended to move an object, a conveyor, etc. accurately. The timing belt mechanism 570 may serve as the primary or secondary driving medium of those systems and a plurality of units may be used.

Figure 8C:
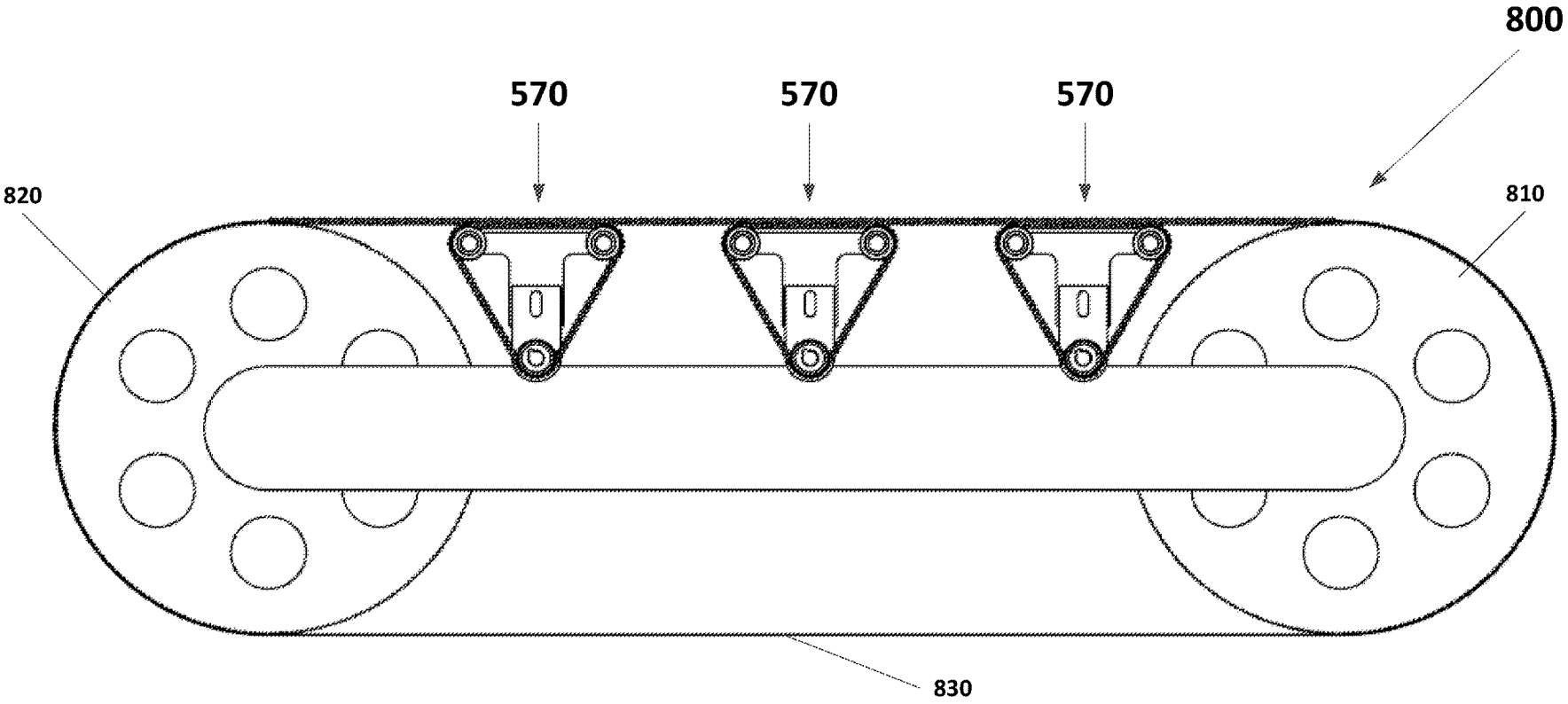
FIG. 8C shows an exemplary application of the timing belt mechanism, according to embodiments of the present invention.

FIG. 8C shows an exemplary application of the timing belt mechanism 570, according to embodiments of the present invention. Conveyor 800 is a known in the art conveyor comprising, for example, one active pulley 810 (or 820), one passive pulley 820 (or 810) and a conveyor belt 830 (a timing belt). In such conveyors, the belt between the pulleys experiences ununiform tension, which in some industries, is crucial and causes the object to be moved to be ununiformly moved. The timing belt mechanism 570 of the present invention may solve this problem. By placing at least one timing belt mechanism 570 in contact with the conveyor belt (timing belt), a uniform tension may be achieved. For the purpose of demonstration three timing belt mechanisms 570 are shown.

It will be appreciated that both pulleys 810 and 820 may be passive and the conveyor belt may be moved by the timing belt mechanisms 570 of the present invention.

Figure 8D:
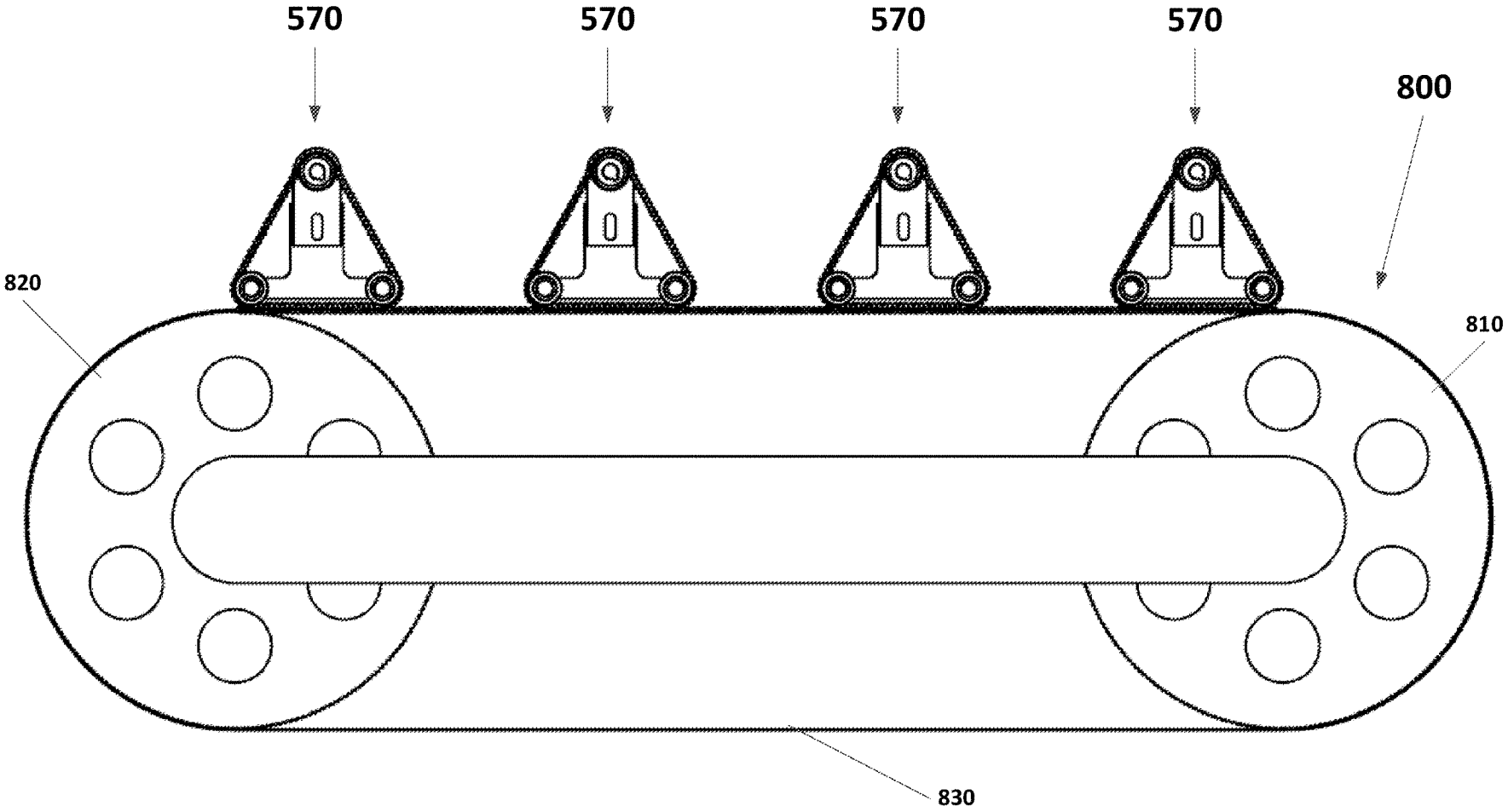
FIG. 8D shows another exemplary application of the timing belt mechanism, according to embodiments of the present invention.

FIG. 8D shows another exemplary application of the timing belt mechanism 570, according to embodiments of the present invention. In this configuration the three timing belt mechanisms 570 are placed on the outer side of and in contact with the conveyor belt 830. For the purpose of demonstration four timing belt mechanisms 570 are shown.

Figure 8E:
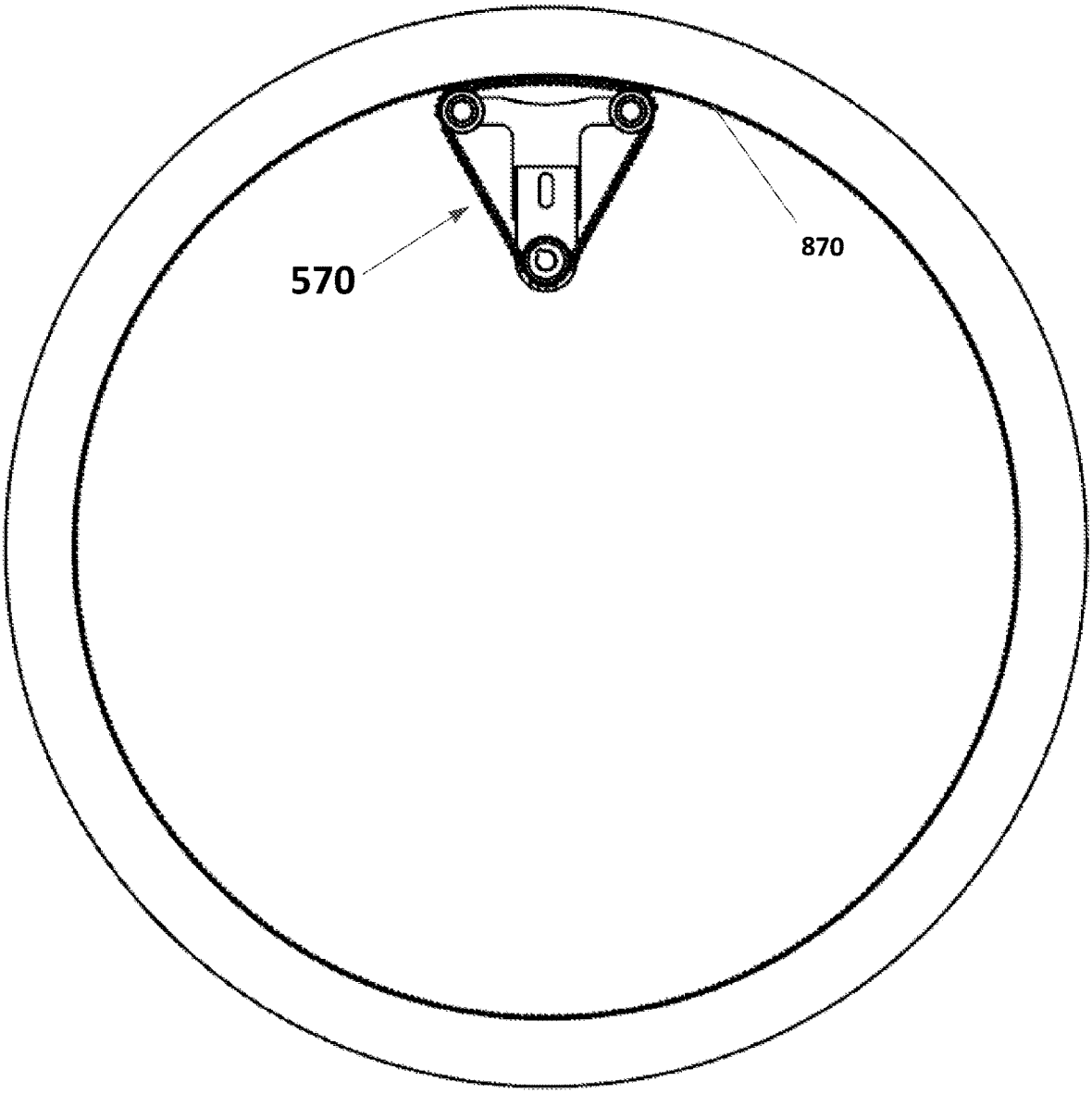
FIG. 8E shows another exemplary application of the timing belt mechanism 570, according to embodiments of the present invention.

FIG. 8E shows another exemplary application of the timing belt mechanism 570, according to embodiments of the present invention. In this configuration the timing belt mechanism 570 is mounted on the inner side of and in contact with the round timing belt 870.

It will be appreciated that there is no limitation to the number of timing belt mechanisms which may be used.

According to embodiments of the present invention, each one of the timing belt mechanisms described in conjunction with FIGS. 8C-8D may comprise a horizontal linear encoder 700 as described in conjunction with FIG. 8B. According to embodiments of the present invention, the encoder may comprise only one encoder scale and/or one reading head.

According to embodiments of the present invention, the substrate's planar profile may be mapped in a pre-scan stage of the entire substrate, by a distance sensor attached to the printing assembly, to provide accurate distance between the substrate and the printing assembly during the printing stage.

Alternatively, the pre-scan and printing may be done concurrently, where a next swath width is scanned while a current swath is being printed, by a distance sensor attached to the printing assembly.

The corrections for substrate irregularity may be made by the controller software, where a Z direction (distance from substrate) movement of the printing head assemblies is calculated to provide a smooth Z movement profile.

As opposed to traditional inkjet printers, in which the substrate is fed to the printer and the printing heads have the ability to traverse the entire width of the substrate, the printer of the present invention is stationed near a stationary substrate where printing may be required end-to-end and where the printing head assemblies' start and end positions may be limited (e.g. by perpendicular walls).

Figure 9A:
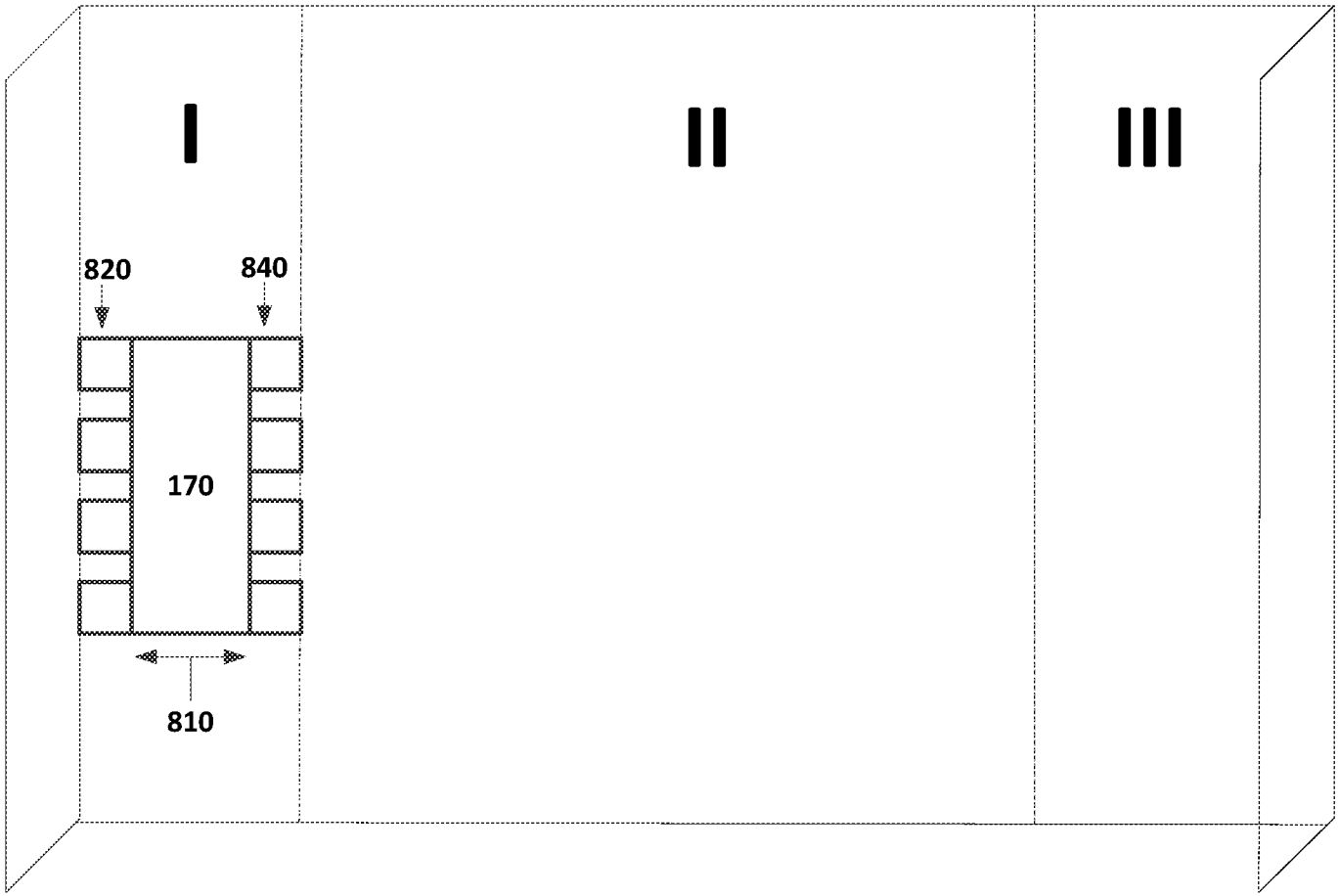
FIG. 9A is a schematic drawing showing three distinct horizontal printing areas, according to embodiments of the present invention.

This constraint defines 3 distinct horizontal printing areas, as schematically shown in FIG. 9A:

Area I, where the printing head assemblies are limited by the left wall;

Area II with no horizontal limitation to the printing head assemblies;

Area III, where the printing head assemblies are limited by the right wall.

Printing in areas I and III require special sequencing of the data sent from the controller to each column of printing head assemblies, as described below in reference to Area I and in conjunction with FIG. 9A.

Since there is a distance 810 between the printing head assemblies' columns (820, 840) and since the printing resolution is higher than the printing head assemblies' native resolution and since part of the printing nozzles may be inoperable at any given time, there is need for more than one printing pass to complete the printing of each area on the substrate, i.e., interlacing. This is normally done by one or more subsequent printing head assemblies/columns "filling" the gaps.

The problem arises when there are no subsequent printing head assemblies, due to a physical barrier (e.g., wall) such as for column 820 in area I. To solve this problem, the printing assembly is constructed so that one column of printing head assemblies (820 in FIG. 9A) is mounted to the left of the printing heads platform 170 and another column of printing head assemblies (840 in FIG. 9A) is mounted to the right of the printing heads platform 170. The controller manipulates the data and the printing head assemblies' movement so that column 820, when in print area I, completes the printing by performing self-interlacing, i.e., performing micro-movements of the printing heads to fill the gaps. Column 840 prints normally, as it will be interlaced with column 820.

The same technique is applied to the rightmost column of printing head assemblies 840 in area III.

Figure 9B:
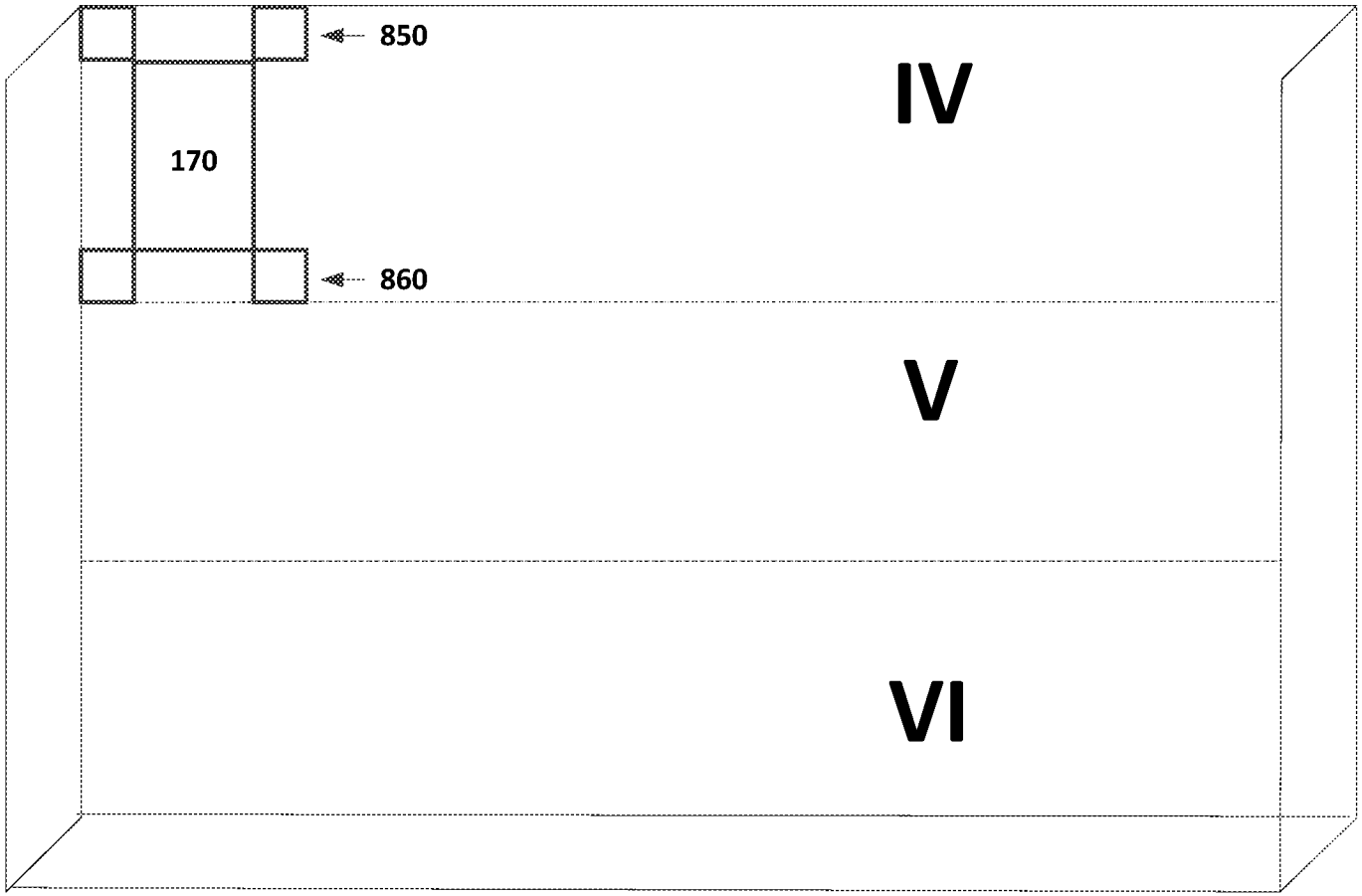
FIG. 9B is a schematic drawing showing three distinct vertical printing areas, according to embodiments of the present invention.

The same constraints define 3 distinct vertical printing areas, constrained by the ceiling and the floor, as schematically shown in FIG. 9B:

Area IV, where the printing head assemblies are limited by the ceiling;

Area V with no vertical limitation to the printing head assemblies;

Area VI, where the printing head assemblies are limited by the floor.

Printing in areas IV and VI require special sequencing of the data sent from the controller to each column of printing head assemblies, as described below in reference to Area IV and in conjunction with FIG. 9A.

To solve this problem, the printing assembly is constructed so that one row of printing head assemblies (850 in FIG. 9B) is mounted on top of the printing heads platform 170 and another row of printing head assemblies (860 in FIG. 9B) is mounted at the bottom of the printing heads platform 170. The controller manipulates the data and the printing head assemblies movement so that row 850, when in print area IV, completes the printing by performing self-interlacing, i.e., performing micro-movements of the printing head to fill the gaps. Column 860 prints normally, as it will be interlaced with column 850.

The same technique is applied to the bottom row of printing head assemblies 860 in area VI.

As mentioned before, according to embodiments of the present invention, the printer of the present invention may be stationed near a stationary substrate where printing may be required end-to-end and where the printing head assemblies' start and end positions may be limited (e.g. by perpendicular walls).

Nevertheless, the objective of the present invention is to enable printing essentially up to the edges of the substrate (e.g., left wall, right wall, ceiling, floor), around objects (e.g. electrical outlet, switch, etc.), near obstacles, etc.

Figure 10:
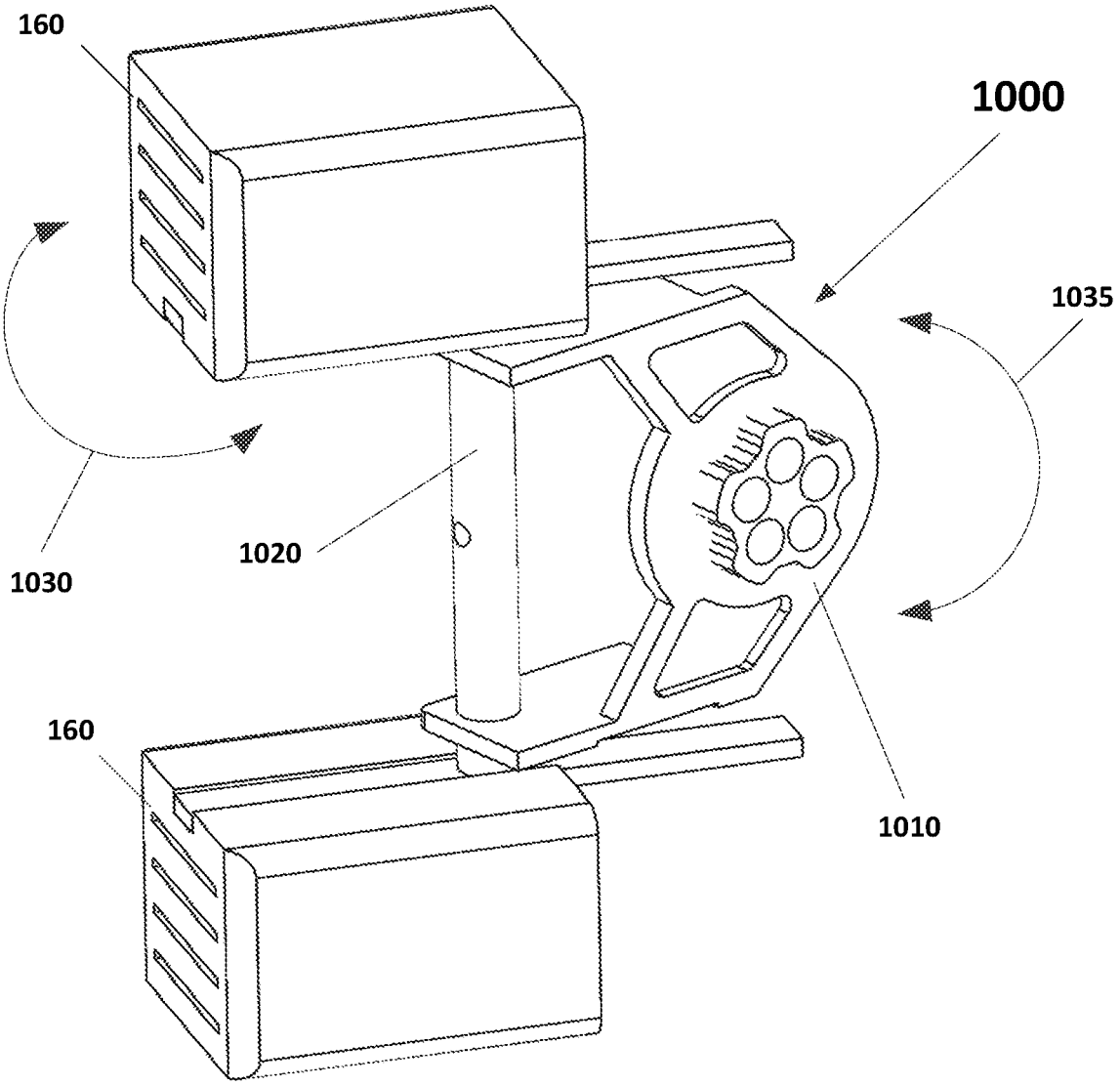
FIG. 10 is a schematic representation of two printing head assemblies connected to a printing heads tilting mechanism, according to embodiments of the present invention.

FIG. 10 shows a printing heads tilting mechanism 1000 according to embodiments of the present invention. The printing heads tilting mechanism 1000 comprises a connector 1010 connected with the printing heads platform (not shown—e.g., 170 of FIG. 1) and with the printing head assemblies 160 via a hinge 1020. The printing heads tilting mechanism enables the printing head assemblies 160 to move in the direction of the dual head arrow 1030 and thereby print essentially up to horizontal edges (left wall, right wall, etc.), object, obstacle, etc. and in the direction of the dual head arrow 1035 and thereby print essentially up to vertical edges (ceiling, floor, etc.), object, obstacle, etc.

Figure 10A:
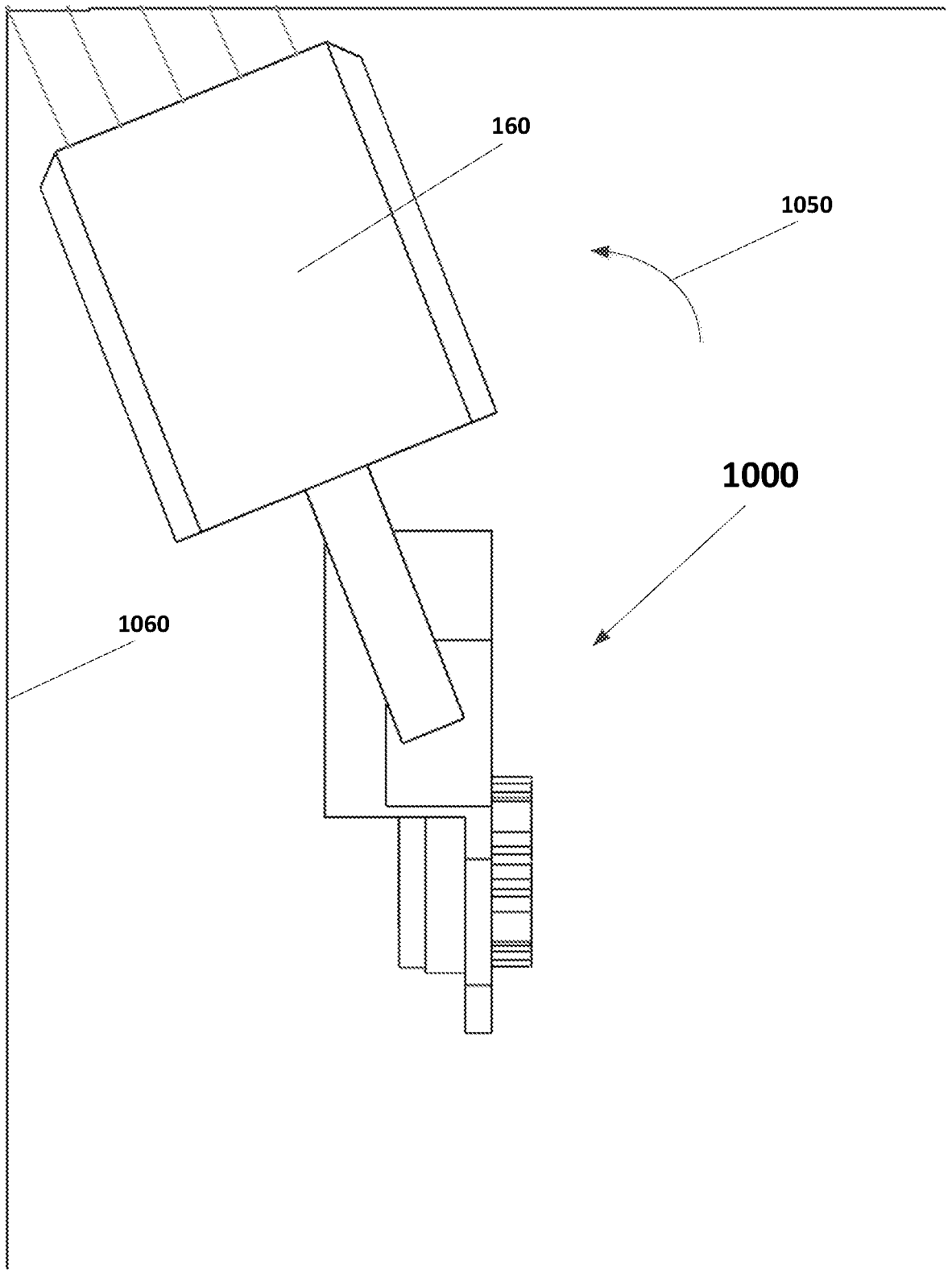
FIG. 10A shows an exemplary position of a printing head assembly for printing essentially up to the wall, object, obstacle, etc. enabled by the printing heads tilting mechanism, according to embodiments of the present invention.

FIG. 10A shows the printing heads tilting mechanism 1000 which, according to embodiments of the present invention, enables the printing head assembly 160 to move in the direction of arrow 1050 and thereby print essentially up to the wall 1060.

Figure 10B:
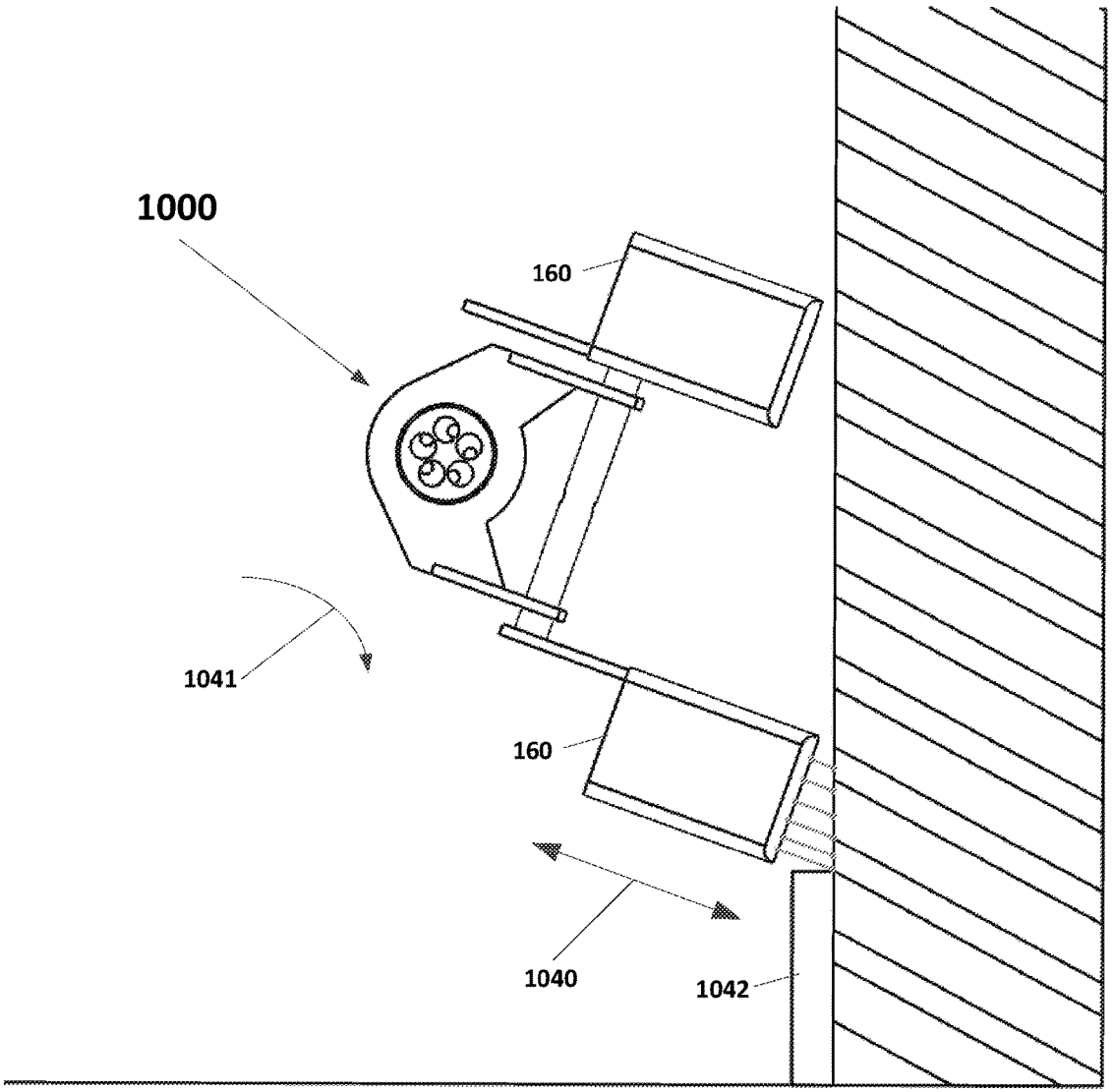
FIG. 10B shows another exemplary position of the printing head assemblies for printing essentially up to the floor, ceiling, object, obstacle, etc. enabled by the printing heads tilting mechanism, according to embodiments of the present invention.

FIG. 10B shows the printing heads tilting mechanism 1000 which, according to embodiments of the present invention, enables the printing head assemblies 160 to move in the direction of arrow 1041 and thereby print essentially up to the floor or in this case essentially up to the panel 1042. Moreover, according to embodiments of the present invention, the printing heads tilting mechanism 1000 may enable the printing head assemblies 160 to move in the directions of the dual head arrow 1040 in order to compensate for the distance from the substrate created by the position angle.

According to embodiments of the present invention, the system controller may manipulate the printed image's data while printing when the printing head(s) is tilted in order to compensate for the printing angle created by the tilt.

According to embodiments of the present invention, the printing may combine simultaneous printing of white color (or any other suitable color) as background and the 4 basic colors (Cyan, Magenta, Yellow, Black), or any kind or number of printing colors of the required design. There is no limitation to the number of printing head assemblies and/or the number of colors.

According to embodiments of the present invention, a primer may be printed to retain the ink to the substrate during the printing process and up to the curing. The primer may be printed as a separate color or mixed with the background color.

According to embodiments of the present invention, the primer is selected to be compatible with the substrate.

Fixation and curing are achieved using monochromatic UV Light Emitting Diodes (LED). According to embodiments of the present invention the UV LEDs are mounted near the printing head assemblies.

The ink formulation is selected to be compatible with the UV LED's wavelengths; it can be a single UV wavelength or combination of wavelengths.

FIGS. 11A to 11J show a front view (from the substrate perspective) of the integrated vertical inkjet printer in an exemplary operation according to embodiments of the present invention.

Figure 11A:
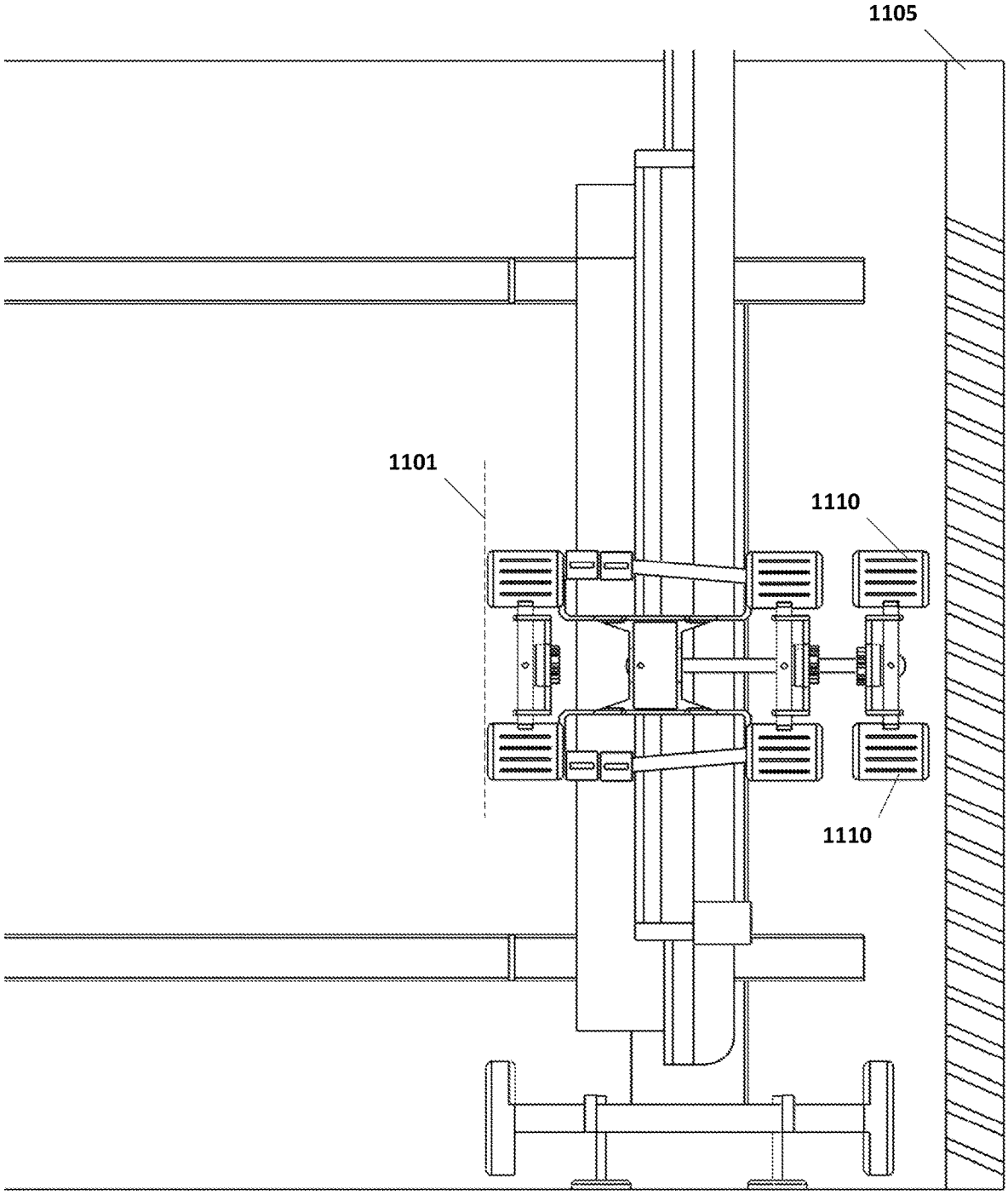
FIG. 11A to 11J show an exemplary operation of the integrated vertical inkjet printer according to embodiments of the present invention.

In FIG. 11A, the integrated vertical inkjet printer is positioned next to the left wall 1105 (right wall from the substrate perspective). The process starts with printing a primer and/or a background color using printing head assemblies 1110. The primer and/or the background color assists the inkjet color, which will be printed next, in adhering to the substrate.

Figure 11B:
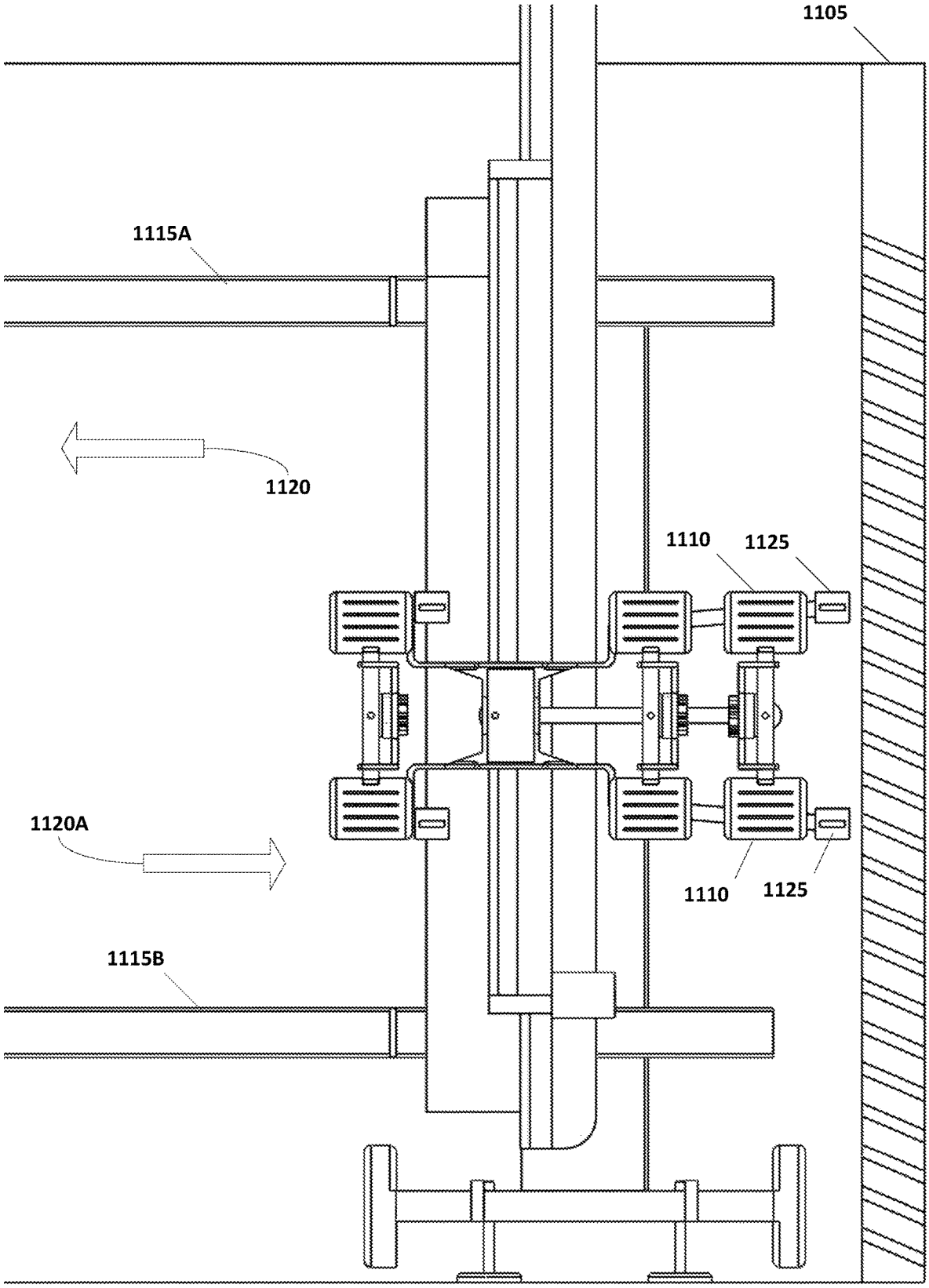

In FIG. 11B, the printing assembly moves along the two horizontal rails 1115A and 1115B in the direction of arrow 1120 a distance which enables the UV curing LEDs 1125 to pop out. The UV curing LEDs are intended to cure the primer and/or the background color deposited by the printing head assemblies 1110 for it to become tacky (sticky) and/or to avoid leakage and thereby to fixate the primer and/or the background color to the substrate. The process continues up to a point where the printing head assemblies 1110 cover the whole printing assembly width. Namely, pass line 1101 of FIG. 11A. When the printing head assemblies 1110 pass the line 1101, the UV curing LEDs are folded, the printing head assemblies 1110 move to the right side of the printing assembly (left from the substrate perspective) and the printing assembly moves back along the two horizontal rails 1115A and 1115B in the direction of arrow 1120A to a position where the printing head assemblies 1130 of FIG. 11C are positioned next to the left wall 1105.

Figure 11C:
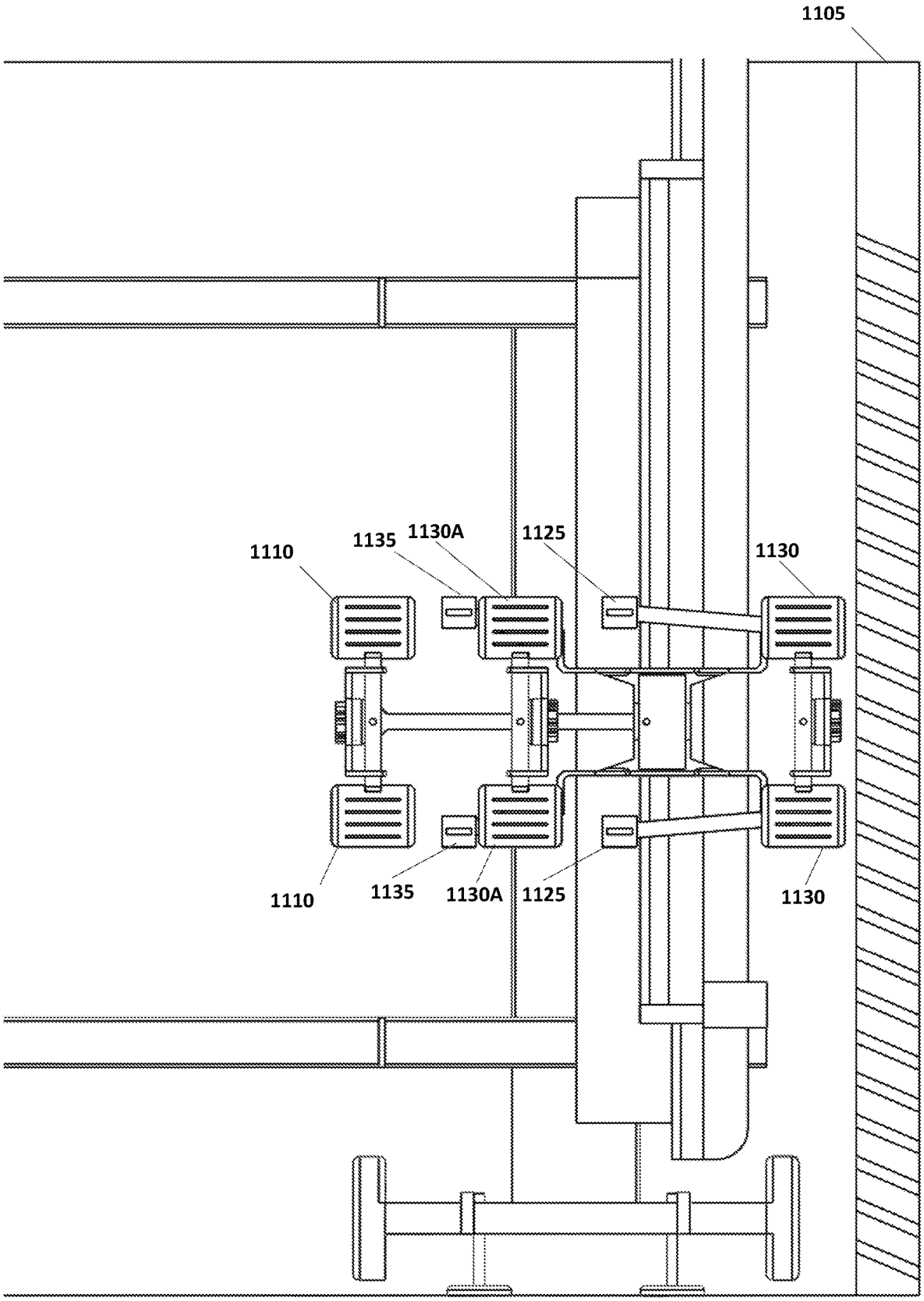

In FIG. 11C, the printing head assemblies 1130 are positioned next to the left wall 1105 after the UV curing LEDs were folded and the printing head assemblies 1110 were moved to the right side of the printing assembly. From this point, the printing assembly may start printing the image, where the printing head assemblies 1110 continue printing the primer and/or the background color, the UV curing LEDs 1135 cure the primer and/or the background color printed layer and the printing head assemblies 1130 and 1130A start printing the image.

Figure 11D:
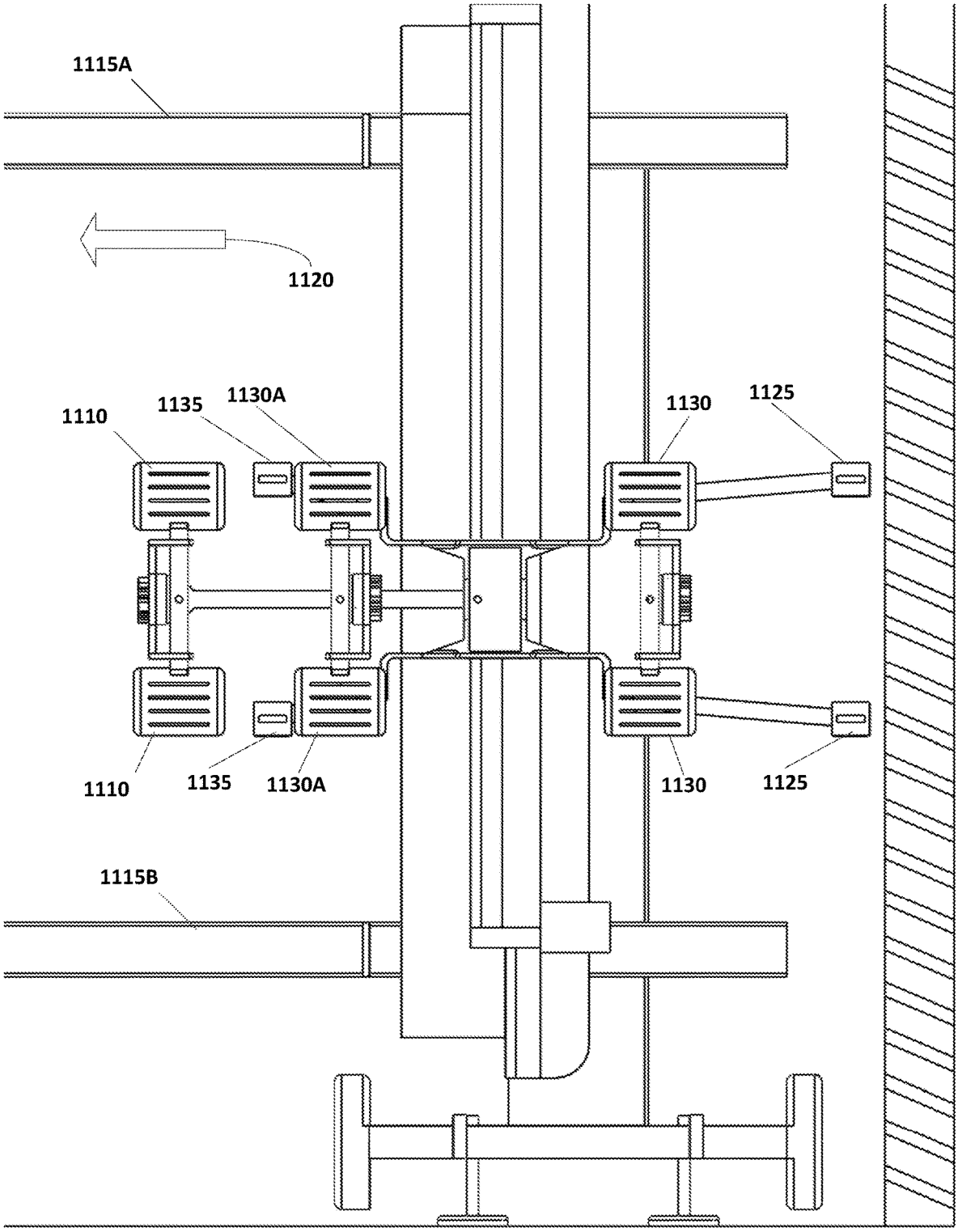

In FIG. 11D, the printing assembly prints the image while it moves along the two horizontal rails 1115A and 1115B in the direction of arrow 1120 a distance which enables the UV curing LEDs 1125 to pop out for curing the printed image.

Figure 11E:
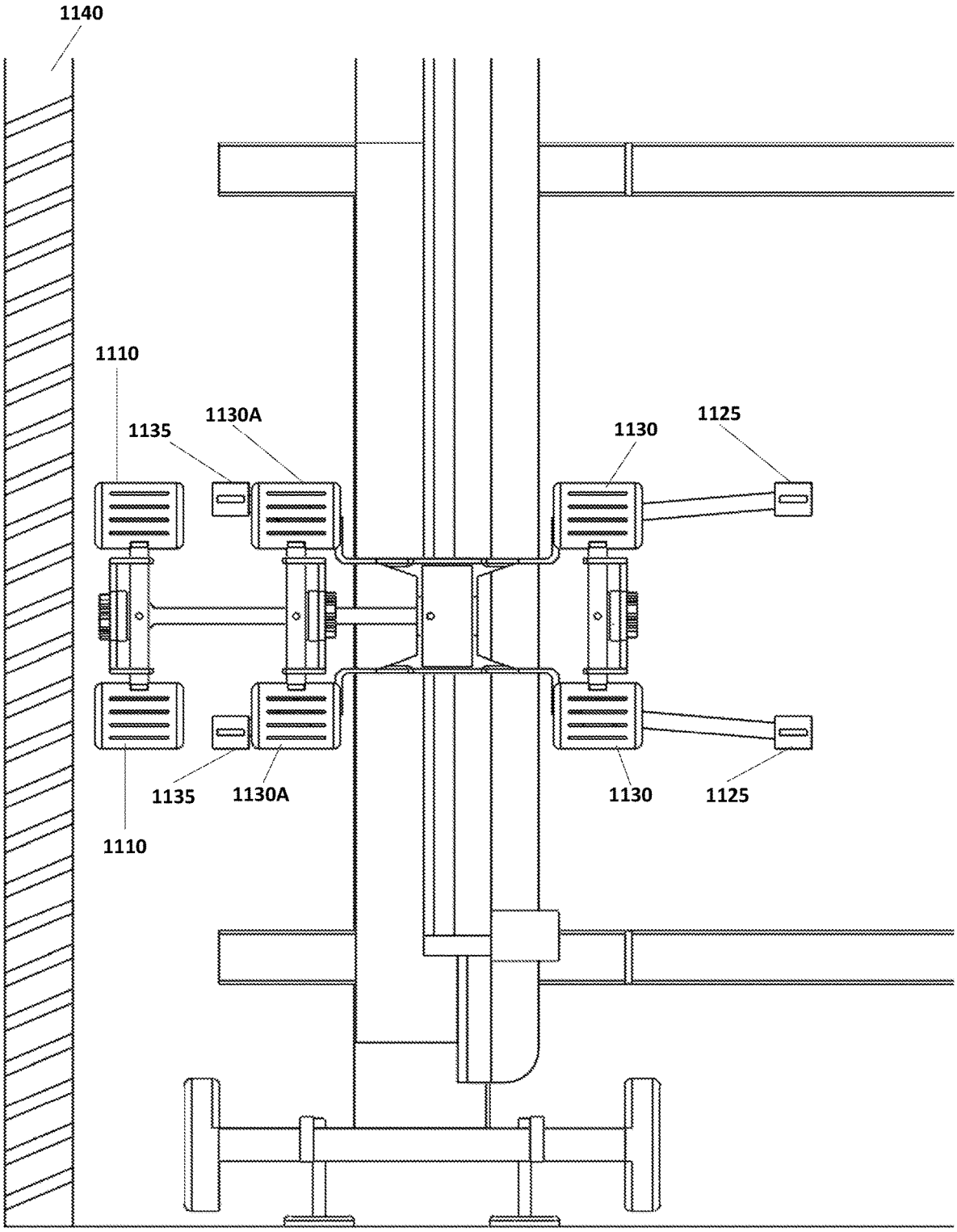

In FIG. 11E, the printing process continues up to the point where the printing head assemblies 1110 reach the right wall 1140 (left wall from the substrate perspective). In this point, the whole substrate is covered by the primer and/or the background color.

Figure 11F:
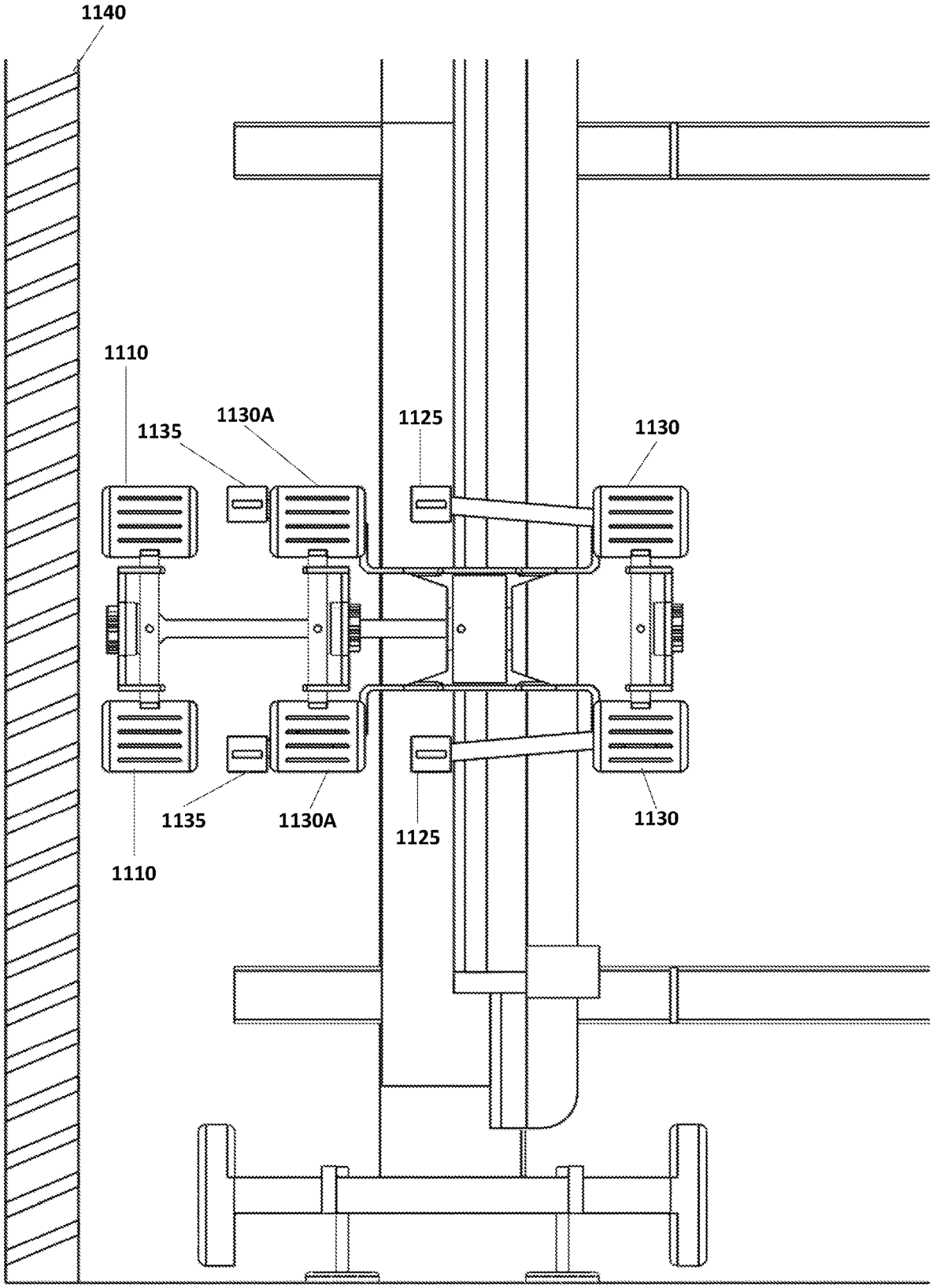

In FIG. 11F, the UV curing LEDs 1125 are folded in order to enable the printing head assemblies 1110 to move to the left side of the printing assembly (right from the substrate perspective).

Figure 11G:
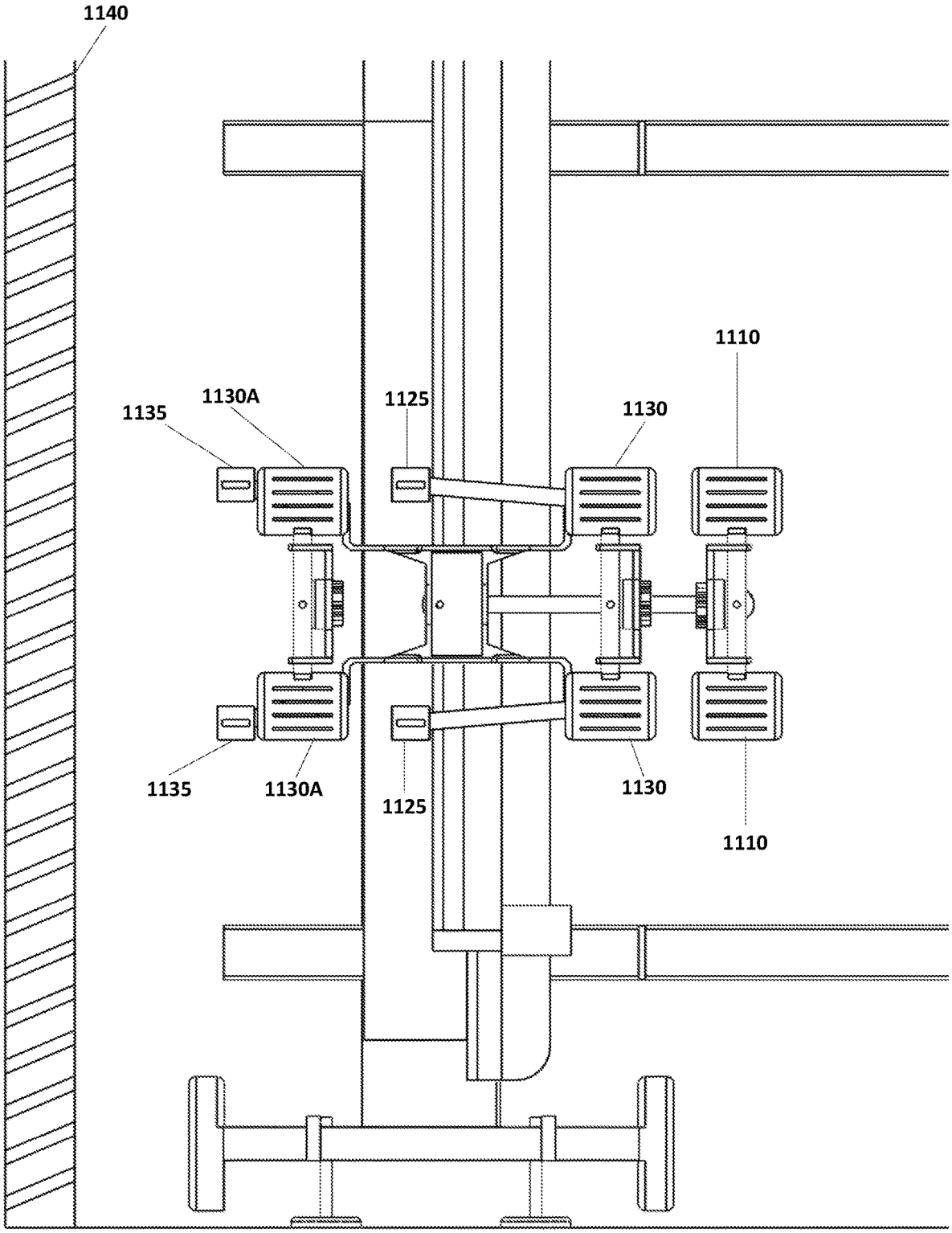

In FIG. 11G, the printing head assemblies 1110 move to the left side of the printing assembly and the UV curing LEDs 1135 may finish curing the rest of the printed image.

Figure 11H:
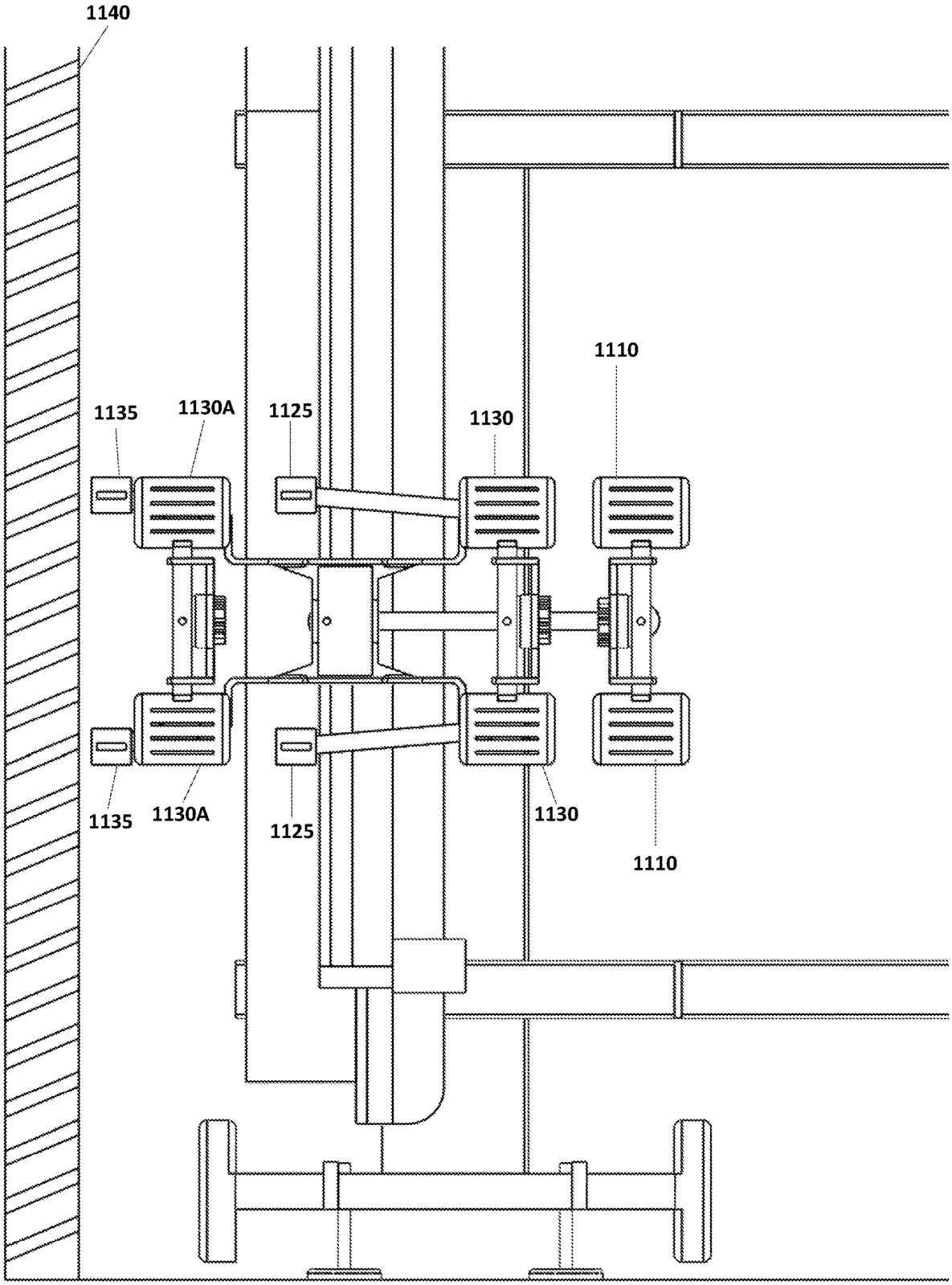

In FIG. 11H, the UV curing LEDs 1135 reach the right wall 1140 (left from the substrate perspective).

Figure 11I:
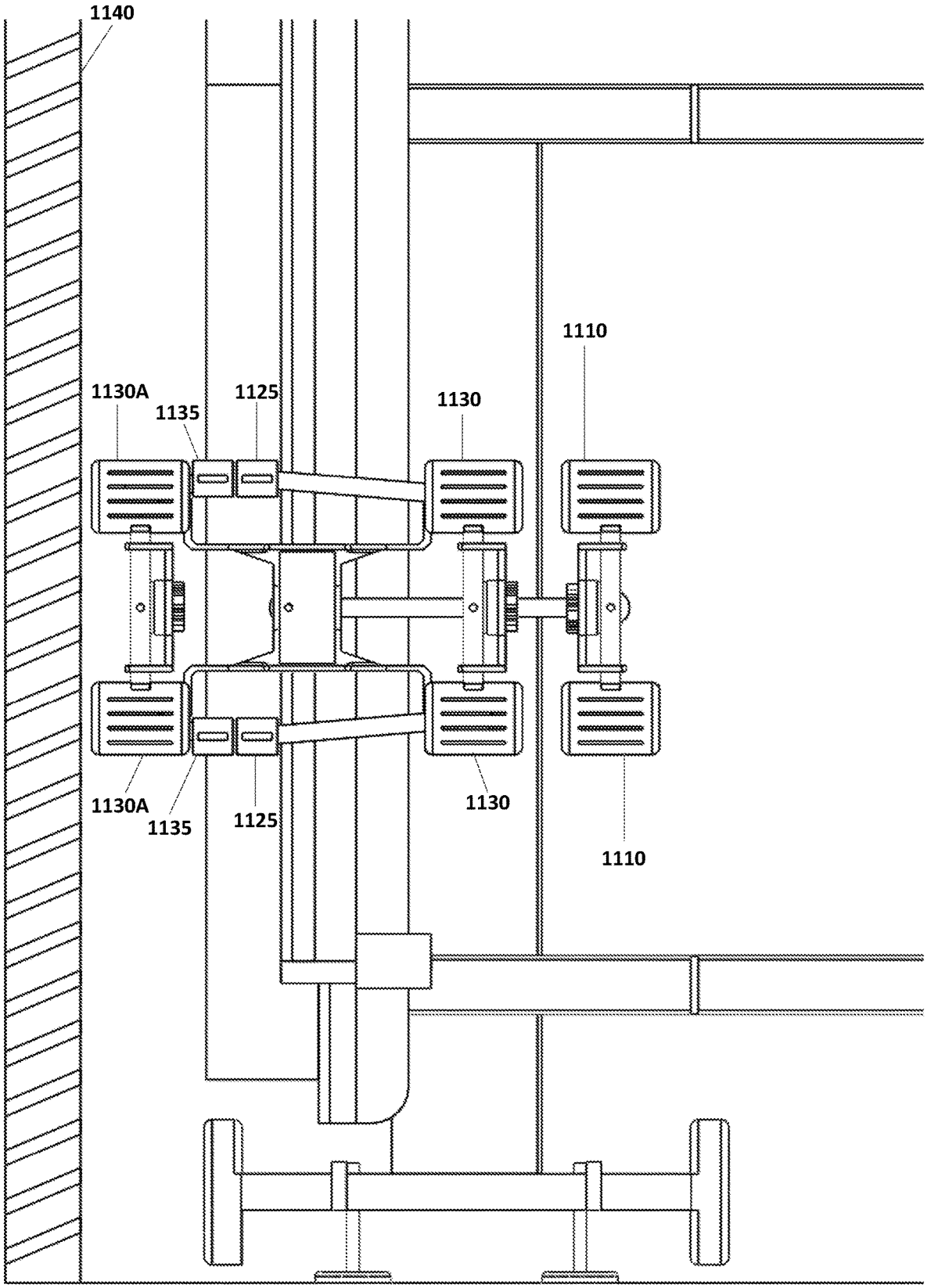

In FIG. 11I, the UV curing LEDs 1135 are folded in order to enable the printing head assemblies 1130A to reach the right wall 1140 (left from the substrate perspective) and thereby complete printing the image.

Figure 11J:
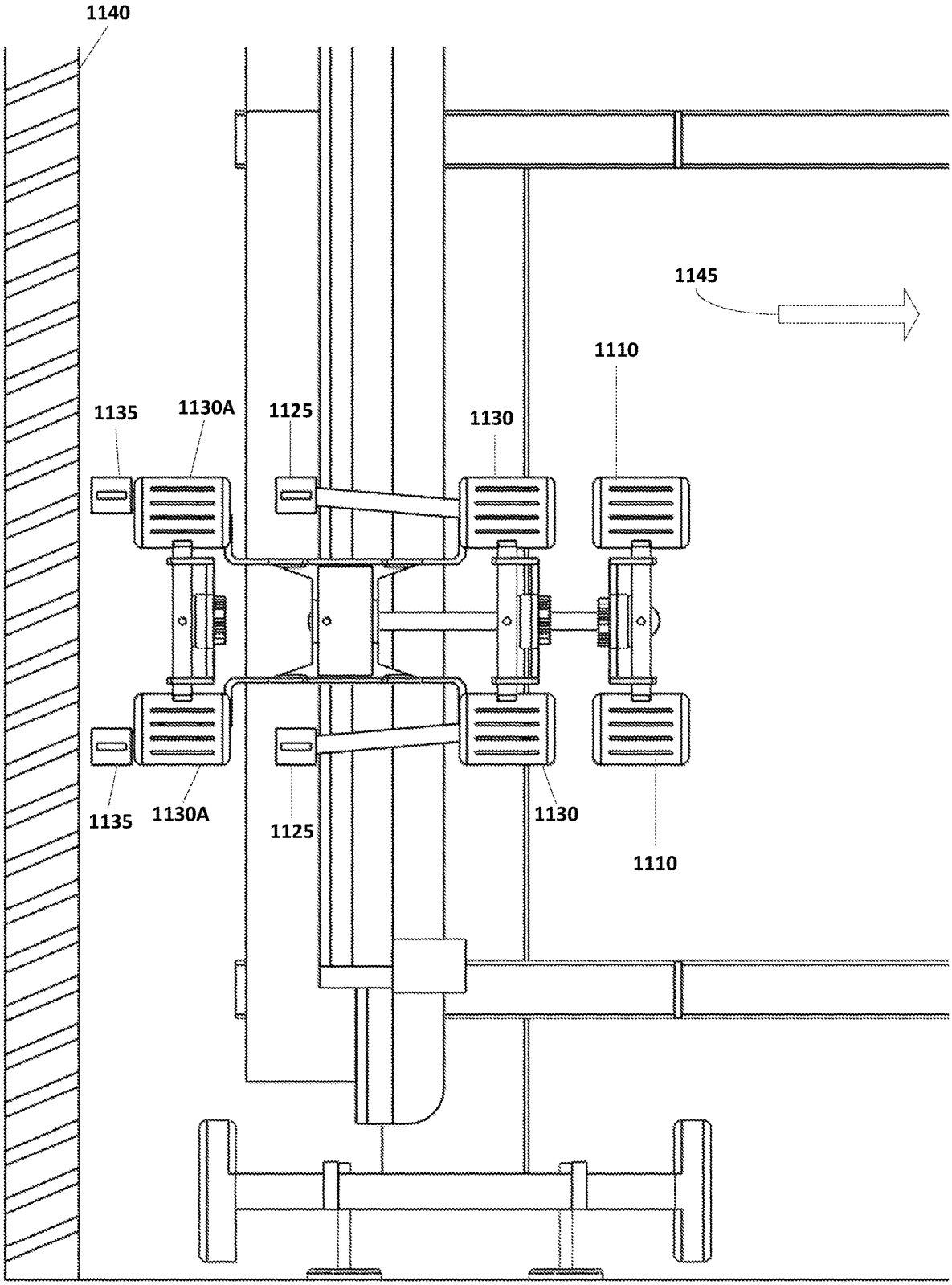

In FIG. 11J, the printing assembly moves in the direction of arrow 1145 to enable the UV curing LEDs 1135 to pop up again in order to cure the printed image part that has not been cured yet.

It will be appreciated that during the image printing process the printing heads tilting mechanism may enable printing essentially up to the ceiling, floor, left wall, right wall, objects, obstacles, etc.

It will be appreciated that a similar process (or parts of the process) may be performed when:

1. The printing assembly is positioned next to the right wall.
2. The printing assembly is positioned anywhere relative to the substrate and intended to reach the right wall.
3. The printing assembly is positioned anywhere relative to the substrate and intended to reach the left wall.

It will be appreciated by persons skilled in the art that the present invention is not limited to what has been particularly shown and described hereinabove. Rather the scope of the present invention is defined by the appended claims and includes combinations and sub-combinations of the various features described hereinabove as well as variations and modifications thereof which would occur to persons skilled in the art upon reading the foregoing description.

The invention claimed is:

1. An integrated vertical inkjet printer for printing on a vertical substrate, comprising:

a controller;

a main trolley carrying a main trolley body; and a printing assembly, comprising:

a plurality of inkjet printing head assemblies mounted on a platform;

a vertical telescopic tandem beam system comprising:

a first printing beam, wherein said platform is slidable along said first printing beam; and a second printing beam detachably insertable between said first printing beam and said main trolley body, a first motor configured to drive said platform vertically;

a second motor configured to drive said first printing beam along said second printing beam;

wherein said platform and said first printing beam can move independently of each other and simultaneously;

a first linear encoder mounted on said first printing beam; and a second linear encoder mounted on said second printing beam;

wherein said first and second linear encoders are configured to provide accurate vertical location data, of said platform relative to said first printing beam and of said first printing beam relative to said second printing beam, to said controller; and wherein said controller is configured to calculate the exact location of said plurality of inkjet printing head assemblies using said location data received from both said first and second linear encoders, thereby controlling printing.

2. The integrated vertical inkjet printer of claim 1, further comprising at least one distance sensor configured to provide accurate positioning of said integrated vertical inkjet printer in relation to said substrate.

3. The integrated vertical inkjet printer of claim 1, wherein said main trolley is mounted on four wheels and comprises automatic floor-leveling elements.

4. The integrated vertical inkjet printer of claim 1, wherein said plurality of inkjet printing head assemblies comprise printing heads mounted above and below said platform, wherein said controller is configured to perform special printing sequences when said heads reach the ceiling or the floor of said substrate, respectively.

5. An integrated vertical inkjet printer for printing on a vertical substrate, comprising:

a controller;

a main trolley carrying a main trolley body;

a first extension trolley carrying a first extension trolley body;

two first horizontal rails detachably connecting said main trolley body and said first extension trolley body; and a printing assembly movable along said two first horizontal rails;

said printing assembly comprises:

a plurality of inkjet printing head assemblies mounted on a platform;

a vertical telescopic tandem beam system comprising:

a first printing beam, wherein said platform is slidable along said first printing beam; and a second printing beam detachably insertable between said first printing beam and said main trolley body;

a first motor configured to drive said platform vertically; and a second motor configured to drive said first printing beam along said second printing beam;

wherein said plurality of inkjet printing head assemblies comprise printing heads mounted to the right and to the left of said platform; and wherein said controller is configured to perform special printing sequences when said heads reach the right wall or the left wall of said substrate, respectively.

6. The integrated vertical inkjet printer of claim 5, further comprising:

a second extension trolley carrying a second extension trolley body;

two second horizontal rails detachably connecting said first extension trolley body and said second extension trolley body;

wherein said printing assembly is movable along said two first horizontal rails and said two second horizontal rails;

a timing belt mechanism configured to provide smooth transition of said printing assembly on each of said two first and second horizontal rails and in between said two first horizontal rails and said two second horizontal rails;

a first linear encoder scale connected with said two first horizontal rails;

a second linear encoder scale connected with said two second horizontal rails; and a linear encoder reader comprising two reading heads, wherein only one of said reading heads is operable at any given time.

7. The integrated vertical inkjet printer of claim 6, further comprising at least one distance sensor configured to provide accurate positioning of said integrated vertical inkjet printer in relation to said substrate.

8. The integrated vertical inkjet printer of claim 6, wherein said main trolley and said first and second extension trolleys are each mounted on four wheels and comprise automatic floor-leveling elements.

9. The integrated vertical inkjet printer of claim 6, wherein said timing belt comprises two tangential timing belts.

10. The integrated vertical inkjet printer of either one of claim 5, further comprising means for mapping the substrate's planar profile before or during printing.

11. The integrated vertical inkjet printer of claim 10, wherein said means for mapping comprise a distance sensor.

12. The integrated vertical inkjet printer of claim 11, wherein said controller is further configured to calculate a smooth distance movement profile for said printing assembly, based on said mapping.

13. The integrated vertical inkjet printer of either one of claim 5, wherein said printing heads assembly comprises a printing head configured to print a background color.

14. The integrated vertical inkjet printer of claim 13, wherein said background color comprises a primer.

15. The integrated vertical inkjet printer of claim 14, further comprising UV monochromatic light Emitting Diodes (UV LED) configured to cure said primer.

16. The integrated vertical inkjet printer of claim 15, wherein said UV LED are mounted near said printing head assembly.

17. A method of printing on a vertical substrate, comprising:

providing a printing assembly comprising four printing head assemblies, two background printing head assemblies, two image UV monochromatic light Emitting Diodes (UV LEDs) and two background monochromatic light Emitting Diodes (UV LEDs);

printing, by said two background printing head assemblies, a background color while moving in a first horizontal direction from a starting point;

curing, by said two background UV LEDs, said background color;

moving said two background printing head assemblies to the other side of said printing assembly;

returning, by said printing assembly, in a second horizontal direction to said starting point;

printing, by said printing head assemblies, while moving in said first horizontal direction an image; and curing, by said two image UV LEDs, said printed image.

18. The method of claim 17, further comprising:

moving said two background printing head assemblies to the other side of said printing assembly;

continue printing said image while curing said background color;

folding said background UV LEDs and continue printing said image; and moving in said second horizontal direction while curing said printed image.

19. A timing belt mechanism system, comprising:

a first timing belt mechanism, comprising:

at least two first pulleys;

wherein at least one of said at least two first pulleys is activated by a first motor; and a first timing belt comprising outer teeth on the outer circumferential surface of said first timing belt, stretched around said at least two first pulleys and configured to be moved by said at least one of said at least two first pulleys activated by said first motor;

wherein at least part of said outer teeth of said first timing belt is configured to directly engage with at least part of a second timing belt's teeth to thereby directly cause movement of said second timing belt in respect to said first timing belt, when said first timing belt is moved; and a second timing belt mechanism, comprising:

at least two second pulleys;

wherein at least one of said at least two second pulleys is activated by a second motor; and a third timing belt comprising outer teeth on the outer circumferential surface of said third timing belt, stretched around said at least two second pulleys and configured to be moved by said at least one of said at least two second pulleys activated by said second motor;

wherein at least part of said outer teeth of said third timing belt is configured to directly engage with at least part of a fourth timing belt's teeth to thereby directly cause movement of said fourth timing belt in respect to said third timing belt, when said third timing belt is moved.

20. The timing belt mechanism of claim 19, wherein said second timing belt is a conveyor timing belt.

21. The timing belt mechanism of claim 19, further comprising at least one encoder comprising at least one reading head and at least one encoder scale.

* * * * *